US007412950B2

(12) United States Patent
Kuroki et al.

(10) Patent No.: US 7,412,950 B2
(45) Date of Patent: Aug. 19, 2008

(54) VALVE OPERATION DEVICE OF INTERNAL COMBUSTION ENGINE

(75) Inventors: Masahiro Kuroki, Saitama (JP); Yutaka Inomoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 408 days.

(21) Appl. No.: 10/564,471

(22) PCT Filed: Jan. 19, 2005

(86) PCT No.: PCT/JP2005/000942

§ 371 (c)(1),
(2), (4) Date: Jan. 13, 2006

(87) PCT Pub. No.: WO2005/068792

PCT Pub. Date: Jul. 28, 2005

(65) Prior Publication Data

US 2008/0060597 A1 Mar. 13, 2008

(30) Foreign Application Priority Data

Jan. 20, 2004 (JP) ..... 2004-012496

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16
See application file for complete search history.

(56) References Cited

U.S. PATENT DOCUMENTS 4,221,199 A * 9/1980 Buuck et al. ..... 123/90.16

(Continued)

FOREIGN PATENT DOCUMENTS

| | | |
|---|---|---|
| JP | 2004-11523 | 1/2004 |
| JP | 2004-353649 | 12/2004 |
| JP | 2005-69014 | 3/2005 |

OTHER PUBLICATIONS

Translation of the International Preliminary Report on Patentability of International Application No. PCT/JP 2005/000942, with Form PCT/IB/373 and Form PCT/ISA/237.

*Primary Examiner*—Thomas Denion
*Assistant Examiner*—Kyle M Riddle
(74) *Attorney, Agent, or Firm*—Westerman, Hattori, Daniels & Adrian, LLP.

(57) ABSTRACT

A variable valve characteristic mechanism has a valve operation cam pivotally supported on a camshaft and a driving mechanism rocking an interlocking mechanism around the camshaft, the interlocking mechanism rocking the valve operation cam by a driving cam integrated into the camshaft. The engine valve starts to open and close in a damping portion of the valve operation cam, and the driving mechanism rocks the valve operation cam via the interlocking mechanism, thereby controlling an opening timing and a closing timing of the engine valve. A cam swelled portion of the driving cam has a constant velocity portion in which a lift velocity is constant, and the constant velocity portion is provided over an angular width where the opening timing in a most advanced angle position of the opening timing of the engine valve and the opening timing in a most retarded angle position of the opening timing are included.

3 Claims, 18 Drawing Sheets

U.S. PATENT DOCUMENTS 6,019,076 A 2/2000 Pierik et al.
7,281,504 B2 * 10/2007 Fujita et al. ..... 123/90.16
7,290,512 B2 * 11/2007 Murata ..... 123/90.16
2006/0207533 A1 * 9/2006 Fujita et al. ..... 123/90.16

* cited by examiner

VALVE OPERATION DEVICE OF INTERNAL COMBUSTION ENGINE

BACKGROUND OF THE INVENTION

1. Field of the Invention

The present invention relates to a valve operation device of an internal combustion engine, and particularly, to a valve operation device having a variable valve characteristic mechanism which controls valve operation characteristics including an opening timing of an engine valve having an intake valve or an exhaust valve.

2. Description of the Related Art

A variable valve operation device disclosed in U.S. Pat. No. 6,019,076, for example, is related to such the valve operation device. The variable valve operation device has a camshaft interlockingly rotating around a crankshaft, a rocking cam rockably supported on a camshaft to open and close an intake valve or an exhaust valve, a control member on which a rocker lever being rocked by a rotational cam integrally rotating with the camshaft to rock the rocking cam is pivotally supported, and an actuator rocking the control member rockably supported on the camshaft. And, the actuator rocks the rocking cam around the camshaft via the control member, and thus an opening timing and a closing timing of the intake valve or the exhaust valve and the most lift amount are controlled.

Generally, a cam swelled portion of a valve operation cam which opens and closes an engine valve has a damping portion which has a low lift velocity, that is, a ratio of a change in height of the cam swelled portion with respect to a change in rotational angle of the camshaft and which includes a constant velocity portion, in order to decrease the slapping sound caused by a crash of a cam or a cam follower into the engine valve due to a valve clearance when the engine valve starts to open and to decrease the slapping sound which is caused when the engine valve is seated in a valve sheet 24 for closing.

In addition, when the damping portion is provided on the rocking cam (corresponding to a valve operation cam) of the conventional art disclosed in U.S. Pat. No. 6,019,076, a rocking angular velocity is responsible for the slapping sound in the damping portion of the rocking cam. Hereinafter, in relation to the conventional art, this will be described for the opening timing of the engine valve with reference to FIGS. 13 and 15. A position with respect to a rotational angle of the camshaft changes according to rocking positions G1 and G2 of the control member. Here, it is assumed that the opening timing of the engine valve is more advanced in the rocking position G1 than in the rocking position G2. As for the cam swelled portion of the rotational cam (corresponding to a driving cam), in rotational positions $\alpha 1$ and $\alpha 2$ corresponding to the opening timing (when the valve clearance is 0) in the damping portion of the rocking cam when the control member is disposed in the rocking positions G1 and G2, as shown in FIG. 13, a lift velocity of the cam swelled portion of the rotational cam (here, the lift velocity corresponds to the rocking angular velocity of the rocking cam which is rocked by the rotational cam via the rocker lever) has a positive acceleration. If this causes the lift velocity to increase according to the rotation of the camshaft, in the rocking position G1, the rocking cam rocks at the rocking angular velocity based on the lift velocity of the rotational cam in the rocking position G1. Accordingly, even when the slapping sound when the engine valve starts to open is set to be decreased based on the valve clearance, in the rocking position G2, the lift velocity of the rotational cam becomes large than that in the rocking position G1, and thus the rocking angular velocity of the rocking cam becomes also large than that in the rocking position G1. For this reason, in the rocking position G2, there may be a case in which a damping function of the damping portion is not fully performed in the rocking position G2 and the slapping sound is caused by the valve clearance. Further, a similar phenomenon may be caused in the closing timing of the engine valve, and thus there may be a case in which the slapping sound is caused when the engine valve is seated in the valve sheet.

SUMMARY OF THE INVENTION

The object of the present invention is to provide a valve operation device of an internal combustion engine in which a slapping sound of an engine valve caused at opening and closing of the engine valve is prevented, by controlling an opening timing and a closing timing of the engine valve in the internal combustion engine where the valve operation device rocks around a camshaft.

The invention provides a valve operation device of an internal combustion engine having a camshaft which interlockingly rotates around a crankshaft of the internal combustion engine, a valve operation cam pivotally supported on the camshaft to open and close an engine valve that comprises one of an intake valve and an exhaust valve, a driving cam which integrally rotates with the camshaft, an interlocking mechanism through which the driving cam rocks the valve operation cam around the camshaft, and a driving mechanism which rocks the interlocking mechanism around the camshaft, wherein the driving cam includes a base circle portion having a sectional shape of a circular arc, and a cam swelled portion having a sectional shape in which a radius from a center different from a center of the base circle portion increases and decreases in a rotation direction of the camshaft, opening and closing of the engine valve start at a damping portion of the valve operation cam, and the driving mechanism rocks the valve operation cam around the camshaft via the interlocking mechanism to control an opening timing and a closing timing of the engine valve, and the cam swelled portion of the driving cam has a constant velocity portion at which a lift velocity, which is a ratio of a change in a height of the cam swelled portion with respect to a change in a rotational angle of the camshaft, is constant, and the constant velocity portion is provided over an angular width that includes at least the opening timing in a most advanced angle position of the opening timing of the engine valve and the opening timing in a most retarded angle position of the opening timing of the engine valve.

According to the valve operation device of the internal combustion engine, when the opening timing and the closing timing of the engine valve are disposed at the most advanced angle position, the most retarded angle position, or an arbitrary position between the most advanced angle position and the most retarded angle position, the engine valve is opened and closed by the damping portion of the valve operation cam which rocks at the same rocking angular velocity by the constant velocity portion. Therefore, through the damping portion having the same rocking angular velocity continuously, the engine valve can start to open and close, regardless of changes in an opening timing and a closing timing controlled.

The angular width may include at least an angular range which ranges from the opening timing in the most advanced angle position of the engine valve to the closing timing in the most retarded angle position of the engine valve.

The angular width may include a starting position of the damping portion of the valve operation cam in the most advanced angle position and an ending position of the damping portion of the valve operation cam in the most retarded angle position.

According to the above-mentioned aspect of the present invention, the following advantages can be obtained. Specifically, the opening timing and the closing timing of the engine valve are controlled by the variable valve characteristic mechanism. Accordingly, at the most advanced angle position, the most retarded angle position, and an arbitrary position between the most advanced angle position and the most retarded angle position, even when the opening timing and the closing timing of the engine valve change, the engine valve can start to open and close at an arbitrary opening timing and an arbitrary closing timing by the damping portion having the same rocking angular velocity continuously. As a result, through the control of the opening timing and the closing timing, the slapping sound of the engine valve when opening and closing can be prevented from being caused.

DETAILED DESCRIPTION OF THE PREFERRED EMBODIMENTS

Hereinafter, an embodiment of the present invention will be described with reference to FIGS. 1 to 14.

Figure 1:
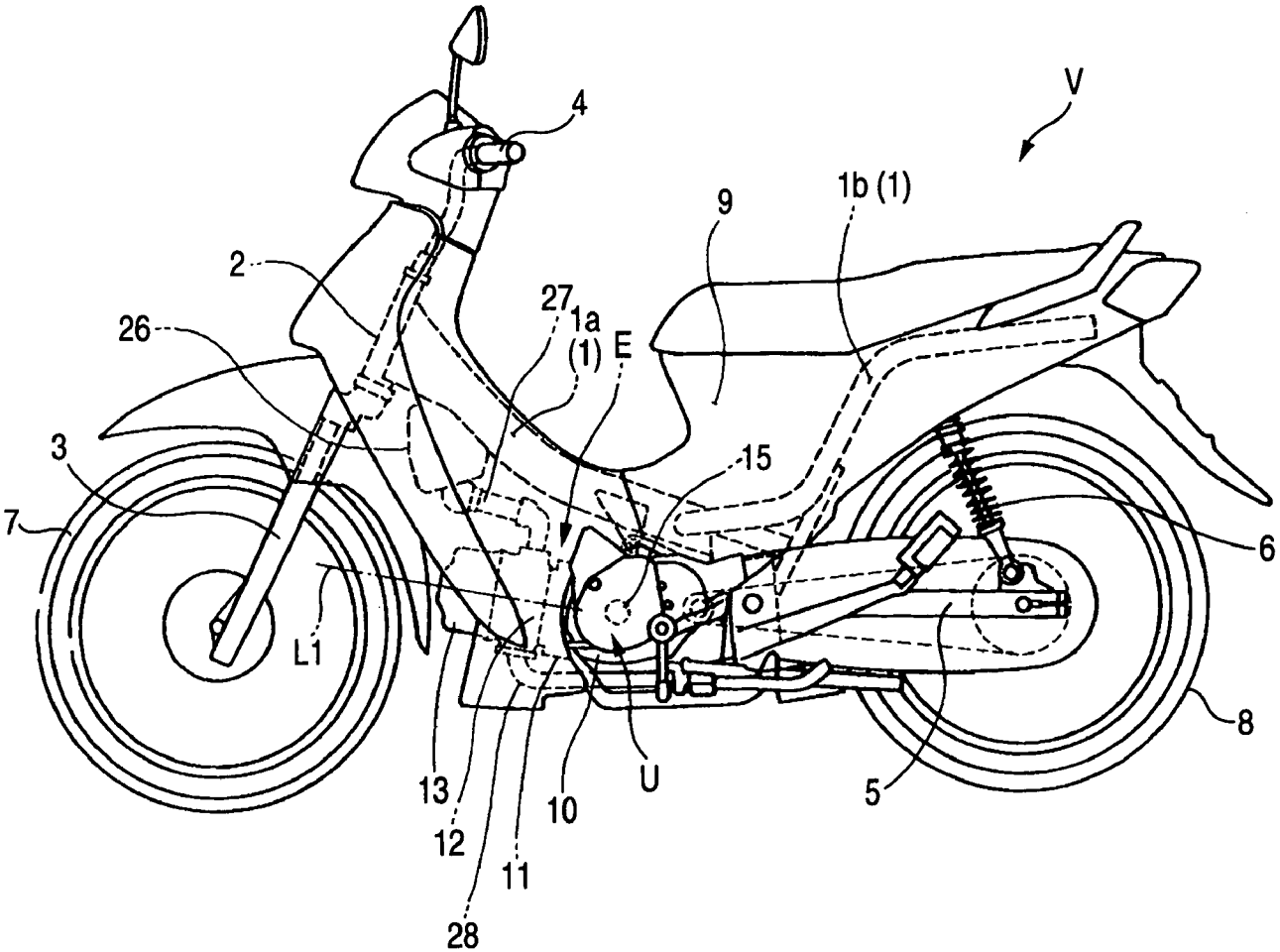
FIG. 1 is a schematic right side view showing a motorcycle having an internal combustion engine mounted thereon.

Referring to FIG. 1, an internal combustion engine E applied to the present invention is mounted on a motorcycle V as a vehicle. The motorcycle V has a body frame 1 having a front frame 1*a* and a rear frame 1*b*; a handle 4 fixed to an upper end of a front fork 3 which is rotatably supported by a head pipe 2 combined with a front end of the front frame 1*a*; a front wheel 7 rotatably supported by a lower end of the front fork 3; a power unit U supported by the body frame 1; a rear wheel 8 rotatably supported by a rear end of a swing arm 5 which is swingably supported by the body frame 1; a rear cushion 6 connecting the rear frame 1*b* with a rear portion of the swing arm 5; and a body cover 9 which covers the body frame 1.

The power unit U has an internal combustion engine E which has a crankshaft 15 extending to the right and left of the motorcycle V and which is horizontally arranged; and a power transmission which has a speed change gear and transmits the power of the internal combustion engine E to the rear wheel 8. The internal combustion engine E has a crankcase 10 which forms a crank chamber for accommodating a crankshaft 15 and also serves as a speed change gear case; a cylinder 11 which is combined with the crankcase 10 and extends forward; a cylinder head 12 combined with a front end of the cylinder 11; and a head cover 13 combined with a front end of the cylinder head 12. A cylinder axis L1 of the cylinder 11 extends forward with a little upward inclination (see FIG. 1) or parallel to the horizontal direction. Also, the rotation of the crankshaft 15 rotatably driven by the piston 14 (see FIG. 2) is speed-changed by the speed change gear and transmitted to the rear wheel 8, and finally, the rear wheel 8 is driven.

Figure 2:
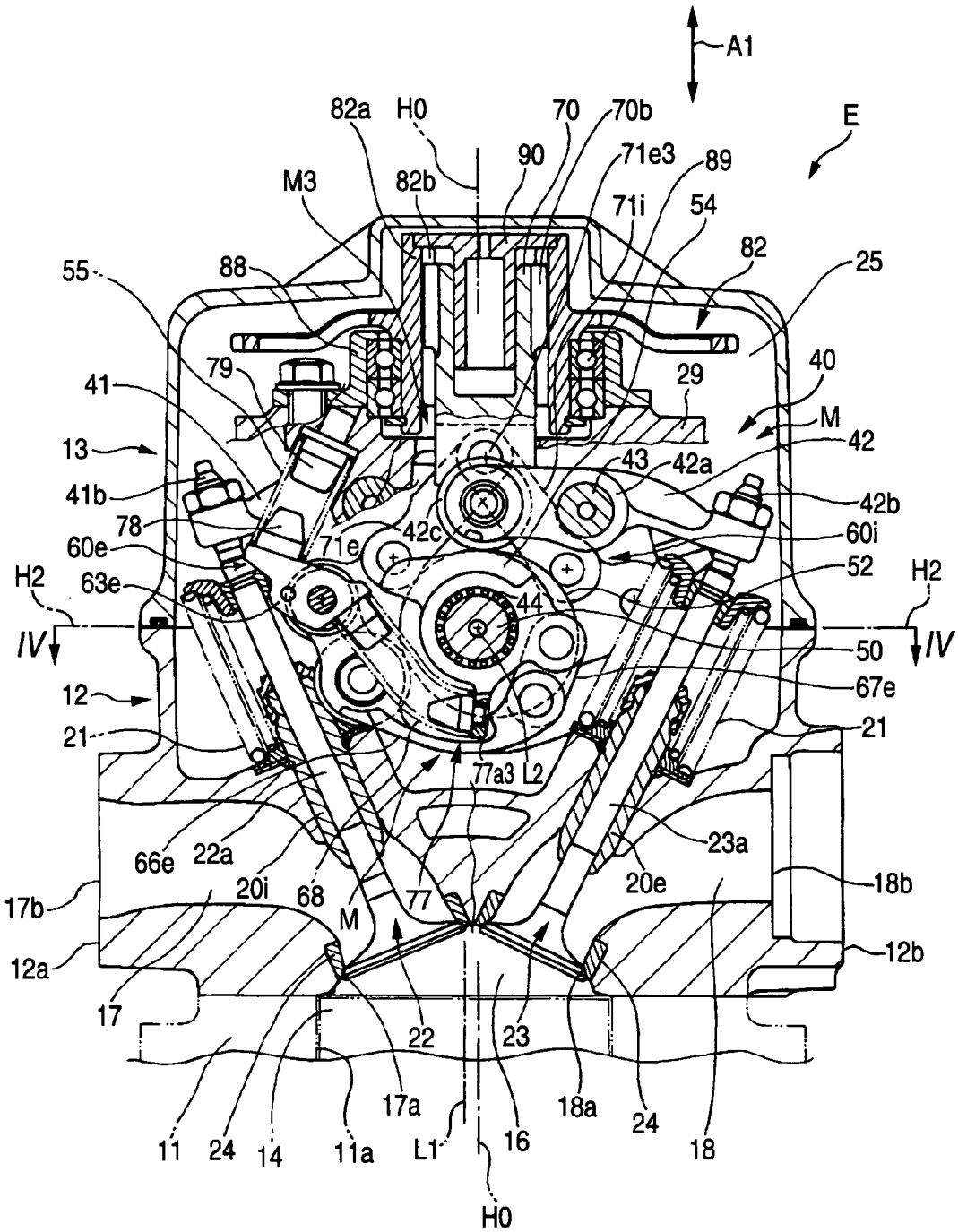
FIG. 2 is a cross-sectional view of the internal combustion engine of FIG. 1 taken along the schematic II-II arrow shown in FIG. 4 and is partially a cross-sectional view taken along the central axis of a valve operation device of an intake valve and an exhaust valve and the central axis of a control shaft.

Referring also to FIG. 2, the internal combustion engine E is an SOHC and air-cooled type single-cylinder 4-stroke internal combustion engine. The cylinder 11 is formed with a cylinder bore 11*a* into which the piston 14 is reciprocably fitted, and a combustion chamber 16 is formed on a surface of the cylinder head 12 facing the cylinder bore 11*a* in the axial direction A1 of the cylinder. The cylinder head 12 is also formed with an intake port 17 having an intake opening 17*a* and an exhaust port 18 having an exhaust opening 18*a*, which are respectively opened to the combustion chamber 16. An ignition plug 19 facing the combustion chamber 16 is inserted into a mounting hole 12*c* formed in the cylinder head 12 so as to be mounted to the cylinder head 12. Here, the combustion chamber 16 constitutes a combustion space along with the cylinder bore 11*a* in a space between the piston 14 and the cylinder head 12.

In addition, the cylinder head 12 is provided with an intake valve 22 and an exhaust valve 23 which are engine valves that are reciprocably supported by valve guides 20*i*, 20*e* and that are always biased in a valve closing direction by valve springs 21. The intake valve 22 and the exhaust valve 23 are operated to be opened or closed by a valve operation device 40 provided in the internal combustion engine E, and opens or closes the intake opening 17*a* and the exhaust opening 18*a* formed in the valve seats 24. The valve operation device 40 except for an electric motor 80 (see FIG. 3) is placed in a valve operation chamber 25 formed by the cylinder head 12 and the head cover 13.

In order to conduct the air taken in from the outside to the intake port 17, an intake system having an air cleaner 26 (see FIG. 1) and a throttle body 27 (see FIG. 1) is mounted on a top face 12*a* that is one side of the cylinder head 12 to which the intake opening 17*b* of the intake port 17 is opened. An exhaust system having an exhaust pipe 28 (see FIG. 1) which conducts the exhaust gas flowing out from the combustion chamber 16 through the exhaust port 18 to the outside the internal combustion engine E is mounted on a bottom face 12*b* of the cylinder head 12 to which the exhaust opening 18*b* of the exhaust port 18 is opened. Further, the intake system is provided with a fuel injection valve that is a fuel supply system which supplies liquid fuel to the intake air.

Also, the air sucked in through the air cleaner 26 and the throttle body 27 is sucked into the combustion chamber 16 through the intake valve 22 which opens in the intake stroke in which the piston 14 move down from the intake port 17, and the sucked air is compressed in a state which is mixed with fuel in the compression stroke in which the piston 14 moves up. The fuel-air mixture is ignited by the ignition plug 19 and combusted at the final phase of the compression stroke, and the piston 14 driven by the pressure of the combusted gas in the expansion stroke in which the piston 14 moves down drives the crankshaft 15 to rotate. The burned gas is discharged to the exhaust port 18 through the exhaust valve 23 which opens in the exhaust stroke in which the piston 14 moves up from the combustion chamber 16.

Referring to FIGS. 2 to 5, 10A and 10B, a valve operation device 40 has an intake main rocker arm 41 which functions as an intake cam follower abutting a valve stem 22*a* to open or close the intake valve 22; an exhaust main rocker arm 42 which functions as an exhaust cam follower abutting a valve stem 23*a* to open or close the exhaust valve 23; and a variable valve characteristic mechanism M which controls a valve operation characteristic including the opening and closing timing of the intake valve 22 and the exhaust valve 23 and the maximum lift amount.

The intake main rocker arm 41 and the exhaust main rocker arm 42 are rockably supported by a pair of rocker shafts 43 which is fixed to a camshaft holder 29 at the supporting points 41*a* and 42*a* of the center part, and abut the valve stem 22*a* and 23*a* at adjusting screws 41*b* and 42*b* which constitute operating parts of one end, and come in contact with the intake cam 53 and the exhaust cam 54 at rollers 41*c* and 42*c* which constitute contacting portions of the other end. Further, a valve clearance C (see FIGS. 10A and 10B) which has a predetermined amount and can be adjusted by the adjusting screws 41*b* and 42*b* is provided between the adjusting screws 41*b* and 42*b*, and the intake valve 22 and the exhaust valve 23.

The variable valve characteristic mechanism M has an internal mechanism which is accommodated in the valve operation chamber 25; and an electric motor 80, an external mechanism which is arranged outside the valve operation chamber 25 and an electric actuator which drives the internal mechanism. The internal mechanism has a camshaft 50 which is rotatably supported by the cylinder head 12 and rotationally driven while interlocking with the crankshaft 15; an intake driving cam 51 and an exhaust driving cam 52 which function as a driving cam which is provided on the camshaft 50 and rotates integrally with the camshaft 50; link mechanisms M1*i* and M1*e* which function as an interlocking mechanism which is pivotally supported by the camshaft 50 and is rockable around the camshaft 50; an intake cam 53 and an exhaust cam 54 which function as a valve operating cam which is connected to the link mechanisms M1*i* and M1*e* and is pivotally supported by the camshaft 50 to operate the intake main rocker arm 41 and the exhaust main rocker arm 42; a driving mechanism M2 having the electric motor 80 as a driving source to rock the link mechanisms M1*i* and M1*e* around the camshaft 50 (see FIG. 3); a controlling mechanism M3 which is disposed between the driving mechanism M2 and the link mechanisms M1*i* and M1*e*, and controls the rocking of the link mechanisms M1*i* and M1*e* around the camshaft 50 according to the driving force of the electric motor 80; and a pressing spring 55 which functions as a pressing and biasing means which exerts a torque around the camshaft 50 to the link mechanisms M1*i* and M1*e* to push the link mechanisms M1*i* and M1*e* against the controlling mechanism M3.

Figure 3:
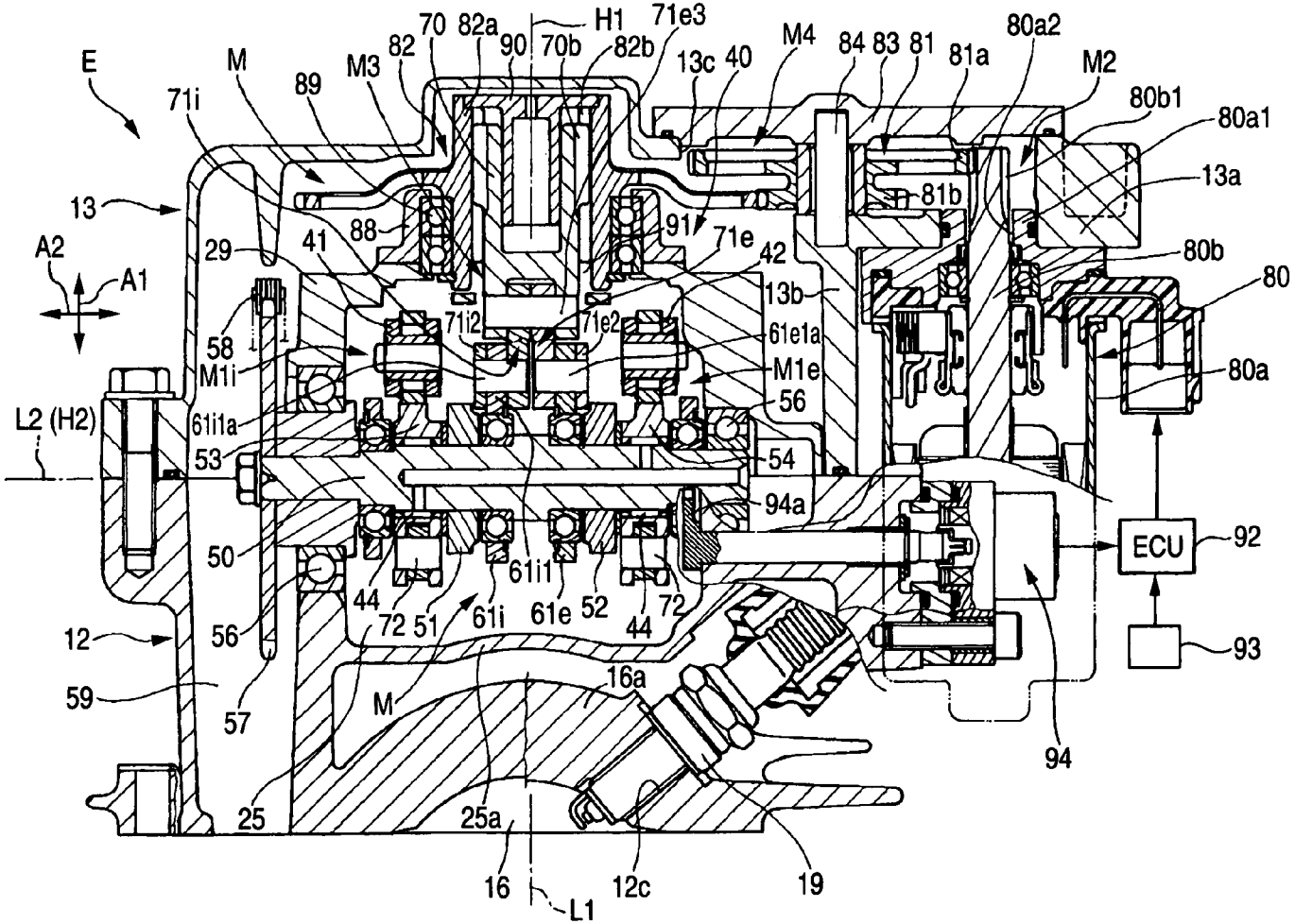
FIG. 3 is a cross-sectional view of the internal combustion engine of FIG. 1 taken from the schematic IIIa-IIIa arrow shown in FIG. 8 and is partially a cross-sectional view taken along the schematic IIIb-IIIb arrow.
Figure 4:
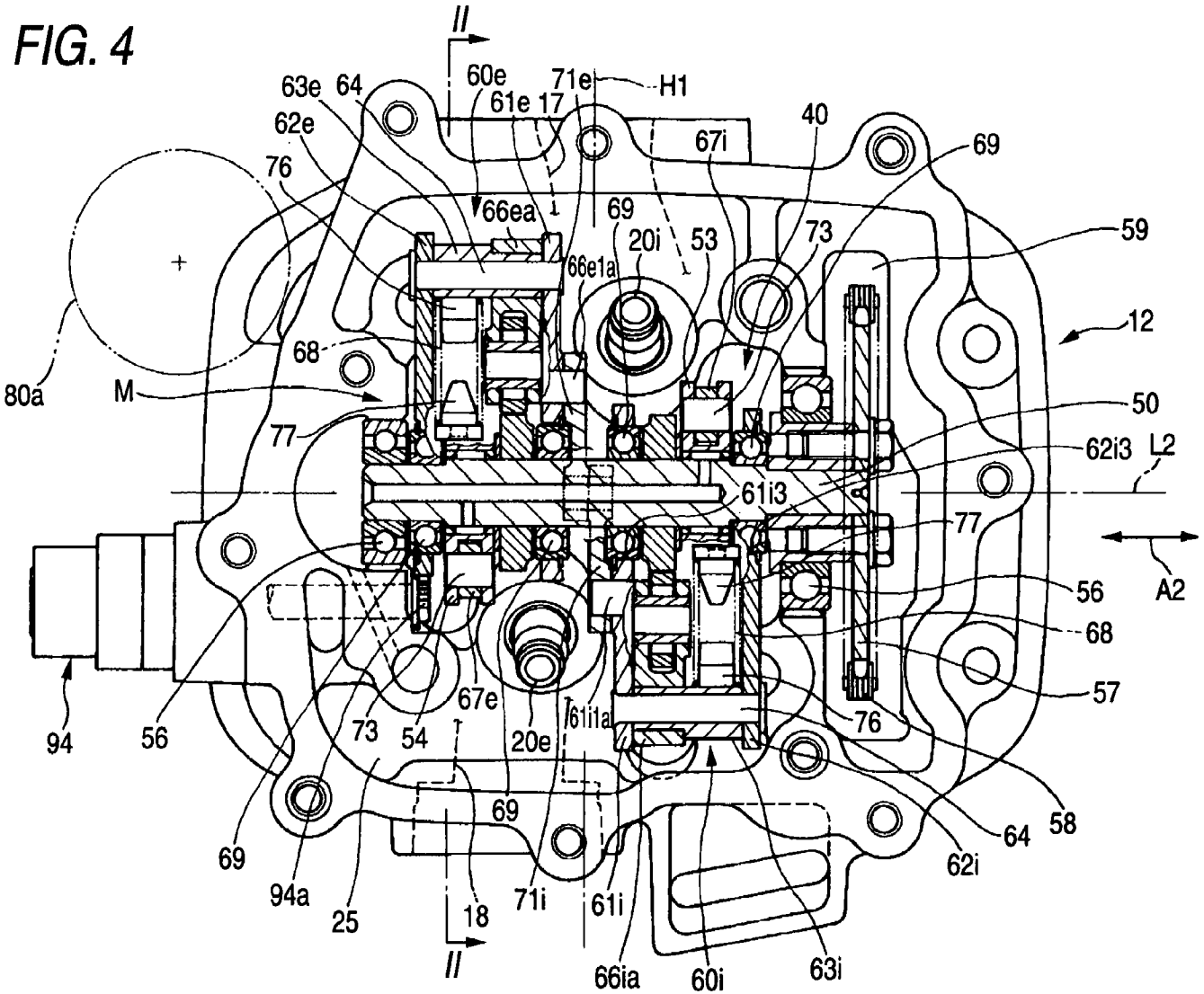
FIG. 4 is a cross-sectional view of a valve operation device of the internal combustion engine of FIG. 1 taken from the schematic IV-IV arrow shown in FIG. 2 when a head cover is removed and is partially a cross-sectional view schematically showing elements of the valve operation device.
Figure 5:
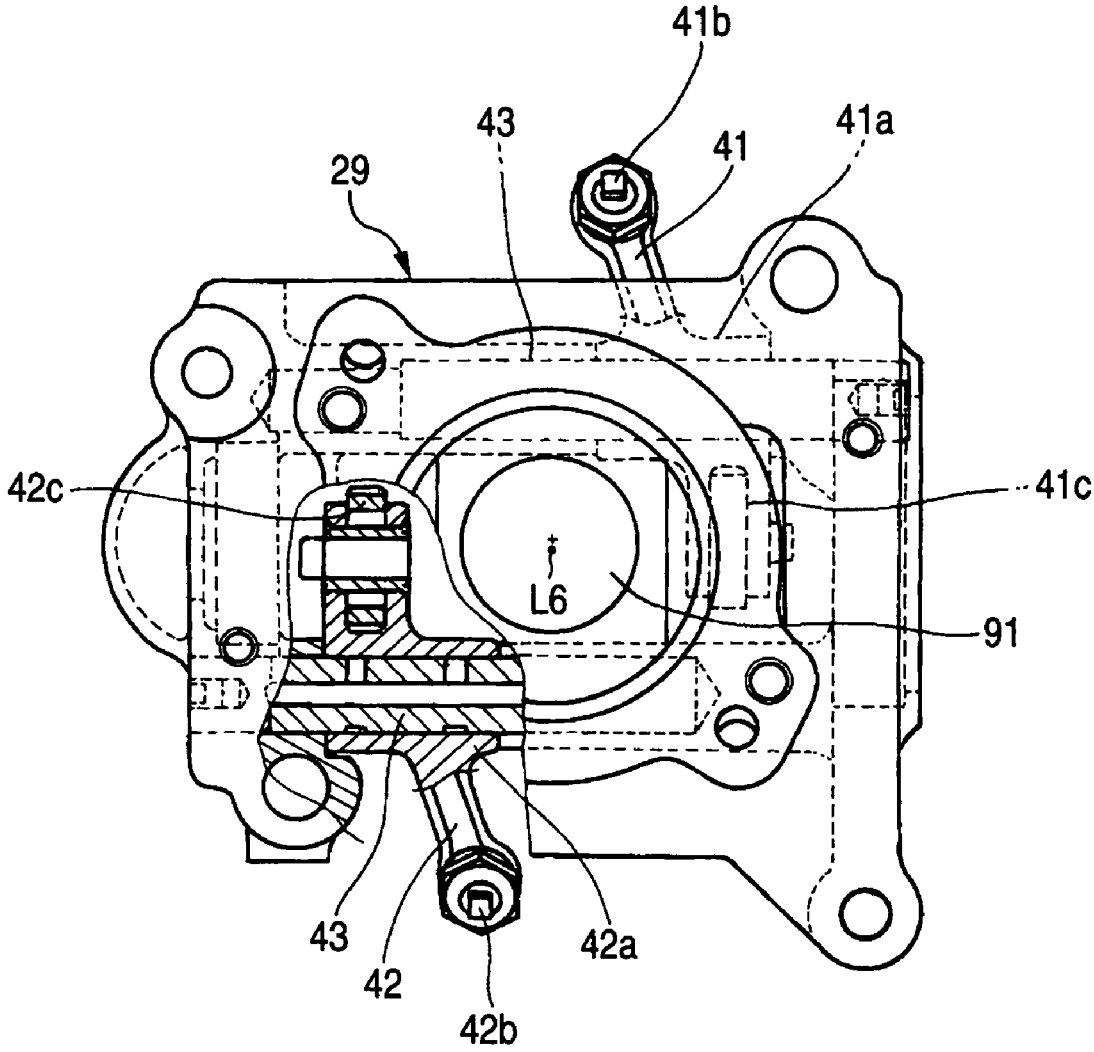
FIG. 5 is a diagram of a camshaft holder mounted on a cylinder head in the internal combustion engine of FIG. 1 as viewed from the head cover along an axis of the cylinder.

Referring to FIGS. 2 to 4, the camshaft 50 is rotatably supported by the cylinder head 12 and the camshaft holder 29 combined with the cylinder head 12 through a pair of bearings 56 which is arranged at both ends of the camshaft 50, and is operated together with the crankshaft and is rotationally driven at half of the revolution speed of the crankshaft 15 while interlocking therewith it by the power of the crankshaft 15 (see FIG. 1) transmitted through the power transmitting mechanism for operating the valve. The power transmitting mechanism for valve-operating has a cam sprocket 57 integrally combined with a front end of a left end of the camshaft 50 that is one end thereof; a driving sprocket integrally combined with the crankshaft 15; and a timing chain 58 which crosses the cam sprocket 57 and the driving sprocket. The power transmitting mechanism for valve-operating is accommodated in the power transmitting chamber which is formed by the cylinder 11 and the cylinder head 12 and is located at the left side of the cylinder 11 and the cylinder head 12 that is one side to a first orthogonal plane H1. Also, the power transmitting chamber 59 formed on the cylinder head 12 among the power transmitting chamber adjoins the valve operation chamber 25 in the diametrical direction from the cylinder axis L1 (hereinafter referred to as a diametrical direction) and in an axial direction A2 of a rotational center line L2 of the camshaft 50 (hereinafter referred to as an axial direction A2 of a camshaft). Here, the first orthogonal plane H1 is a plane which includes the cylinder axis L1 and crosses a reference plane H0 as described later at right angle.

In addition, in the variable valve characteristic mechanism M, members relating to the intake valve 22 and the exhaust valve 23 includes members corresponding to each other, and the intake driving cam 51, the exhaust driving cam 52, the link mechanisms M1*i* and M1*e*, the intake cam 53 and the exhaust cam 54 has the same basic structure. Therefore, the following description will be made of the members relating to the exhaust valve 23 and the description on the members relating to the intake valve 22 and the matters concerned will be written in parentheses as necessary.

Referring to FIGS. 2, 3, 6A, 6B, 7A to 7D, 10A and 10B, the exhaust driving cam 52 (the intake driving cam 51) which is press-fitted into and fixed to the camshaft 50 has a cam surface formed over its entire circumferential surface. This cam surface consists of a base circle portion 52*a* (51*a*) which does not rock the exhaust cam 54 (the intake cam 53) through the link mechanism M1*e* (M1*i*) and a cam swelled portion 52*b* (51*b*) which rocks the exhaust cam 54 (the intake cam 53) through the link mechanism M1*e* (M1*i*). The base circle portion 52*a* (51*b*) has a sectional shape of a circular arc with a predetermined radius from the rotational center line L2, and the cam swelled portion 52*b* (51*b*) has a sectional shape in which the radius from the rotational center line L2 increases and then decreases in the direction of the rotation direction R1 of the camshaft 50. Also, the base circle portion 52*a* (51*a*) sets a rocking position of the exhaust cam 54 (the intake cam 53) so that the exhaust main rocker arm 42 (the intake main rocker arm 41) comes in contact with the base circle portion 54*a* (53*a*) of the exhaust cam 54 (the intake cam 53), and the cam swelled portion 52*b* (51*b*) sets a rocking position of the exhaust cam 54 (the intake cam 53) so that the exhaust main rocker arm 42 (the intake main rocker arm 41) comes in contact with the base circle portion 54*a* (53*a*) of the exhaust cam 54 (the intake cam 53) and the cam swelled portion 54*b* (53*b*).

The link mechanisms M1*i* and M1*e* have the intake link mechanism M1*i* linked to the intake cam 53; and the exhaust link mechanism M1*e* linked to the exhaust cam 54. Referring to FIGS. 3 and 4, the exhaust link mechanism M1*e* (the intake link mechanism M1*i*) has a holder 60*e* (60*i*) which is pivotally supported by the camshaft 50 and rockable around the camshaft 50; an exhaust sub-rocker arm 66*e* (an intake sub-rocker arm 66*i*) which is pivotally supported by the holder 60*e* (60*i*) and is driven by the exhaust driving cam 52 (the intake driving cam 51) to be rockable; a connecting link 67*e* (67*i*) whose one end is pivotally mounted to the exhaust sub-rocker arm 66*e* (the intake sub-rocker arm 66*i*) and whose other end is pivotally mounted to the exhaust cam 54 (the intake cam 53); and a control spring 68 which pushes the exhaust sub-rocker arm 66*e* (the intake sub-rocker arm 66*i*) against the exhaust driving cam 52 (the intake driving cam 51).

Figure 6A:
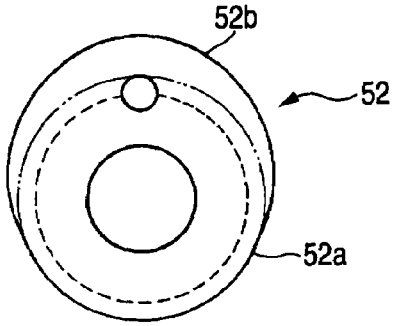
FIG. 6A is a diagram of an exhaust driving cam of a variable valve characteristic mechanism in the valve operation device of the internal combustion engine of FIG. 1 as viewed from the camshaft and FIG. 6B is a diagram showing a state in which an exhaust link mechanism and the exhaust cam of the variable valve characteristic mechanism are pivotally moved.
Figure 6B:
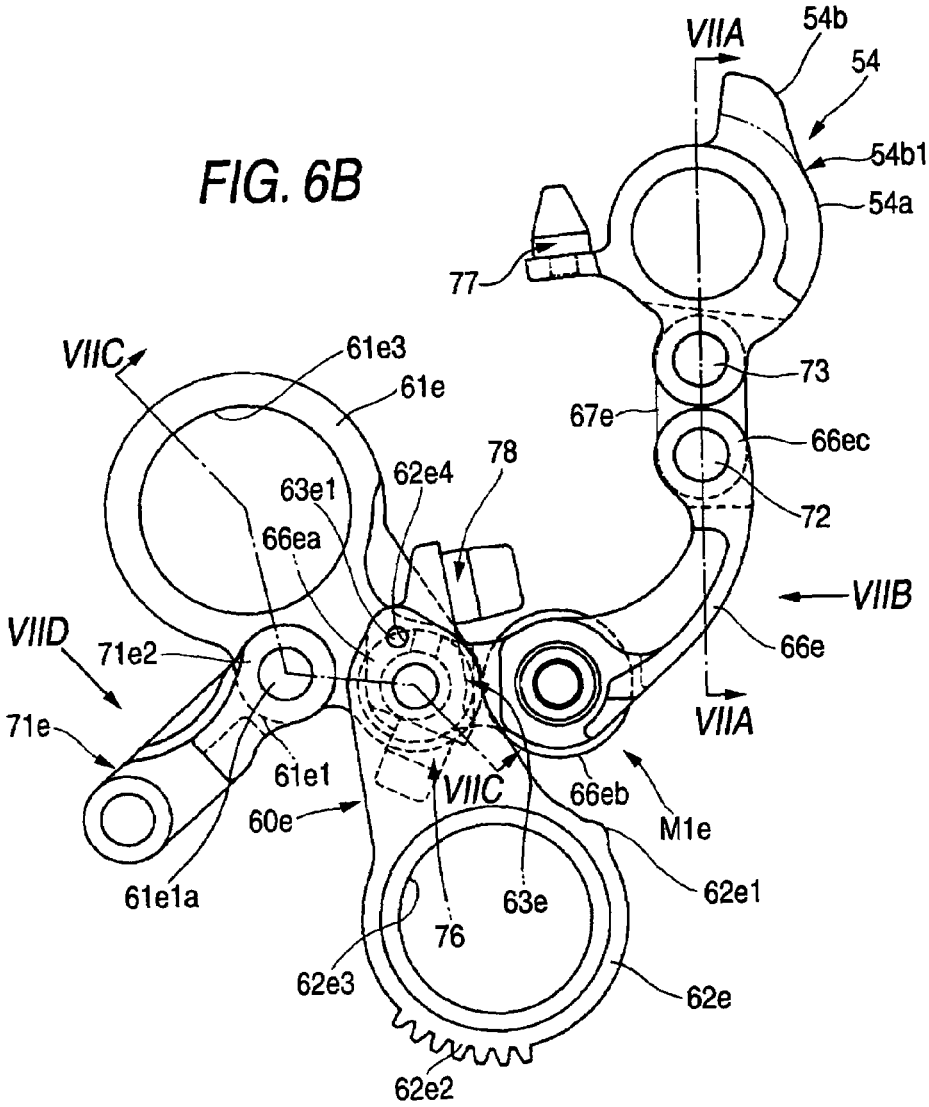
Figure 7A:
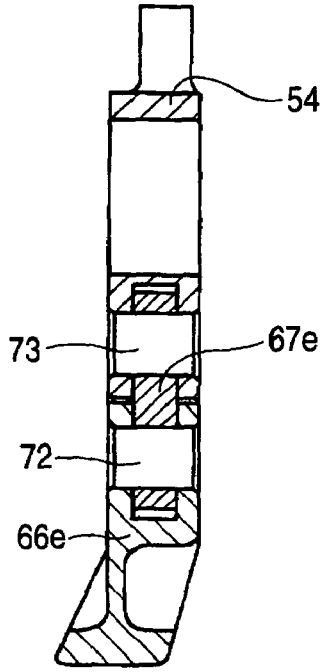
FIG. 7A is a cross-sectional view taken along the VIIA arrow of FIG. 6.
Figure 7B:
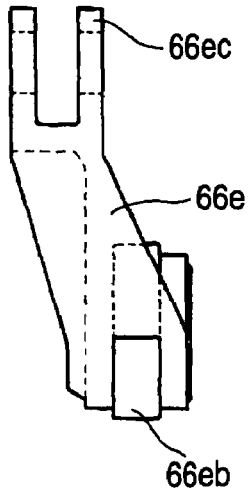
FIG. 7B is a diagram taken from the VIIB arrow of FIG. 6.
Figure 7C:
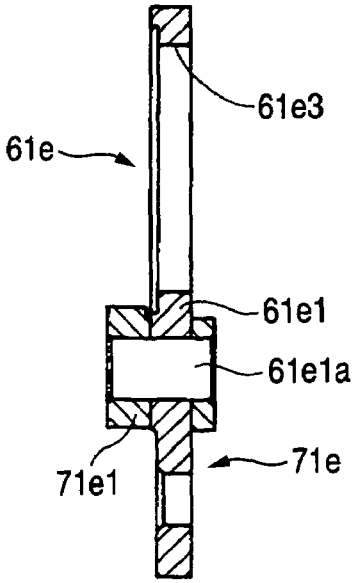
FIG. 7C is a cross-sectional view taken along the VIIC arrow of FIG. 6.
Figure 7D:
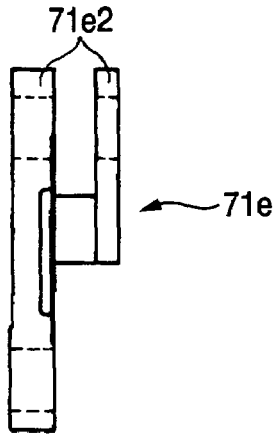
FIG. 7D is a cross-sectional view taken along the VIID arrow of FIG. 6.

The holder 60*e* (60*i*) supported by the camshaft 50 through a bearing 69 into which the camshaft 50 is inserted has a pair of first and second plates 61*e* and 62*e* (61*i* and 62*i*) spaced in the axial direction A2 of the camshaft and a connecting member which connects the first and the second plates 61*e* and 62*e* (61*i* and 62*i*) to each other in the axial direction A2 of the camshaft with a predetermined space left and pivotally supports the exhaust sub-rocker arm 66*e* (the intake sub-rocker arm 66*i*). Also, this connecting member has a collar 63*e* (63*i*) which defines the predetermined space between the both plates 61*e* and 62*e* (61*i* and 62*i*) and functions as a supporting shaft which pivotally supports the exhaust sub-rocker arm 66*e* (the intake sub-rocker arm 66*i*); and a rivet 64 which is inserted into the collar 63*e* (63*i*) and combines both plates 61*e* and 62*e* (61*i* and 62*i*) together. As shown in FIGS. 6A, 6B and 4, mounting holes 61*e*3 and 62*e*3 (61*i*3 and 62*i*3) in which the bearings 69 which rockably support the respective plates 61*e* and 62*e* (61*i* and 62*i*) on the camshaft 50 are formed in the respective plates.

Referring also to FIG. 3, the exhaust control link 71*e* (the intake control link 71*i*) of the controlling mechanism M3 is pivotally mounted to the first plate 61*e* (61*i*), and the exhaust control link 71*e* (the intake control link 71*i*) and the first plate 61*e* (61*i*) are connected to each other in such a the way that both can move relative to each other at connecting parts 71*e*2 and 61*e*1 (71*i*2 and 61*i*1) therebetween. More specifically, a connecting pin 61*e*1*a* (61*i*1*a*) which is pres-fitted into and fixed to a hole of the connecting part 61*e*1 (61*i*1) of the first plate 61*e* (61*i*) which functions as a connecting part on the holder side is inserted into the connecting part 71*e*2 (71*i*2) of the exhaust control link 71*e* (the intake control link 71*i*) which functions as a connecting member on the controlling mechanism side in such a way that the both can move relative to each other.

Also, on the second plate 62*e* (62*i*), a decompression cam 62*e*1 (62*i*1) (see FIGS. 6A, 6B, 10A and 10B) for facilitating the starting by slightly opening the intake valve 22 and the exhaust valve 23 in the compression stroke and thus lowering the compression pressure at the starting of the internal combustion engine E is formed. In addition, on the second plate 62*e*, a detected part 62*e*2 detected by a detecting part 94*a* of a rocking position detecting means 94 (see FIGS. 12A and 12B) is provided. The detected part 62*e*2 consists of a toothed part which meshes a toothed part constituting the detecting part 94*a* to engage in the rocking direction of the second plate 62*e*. In addition, even though not used in the present embodiment, the second plate 61*i* is also provided with a part 62*i*2 corresponding to the detected part 62*e*2.

On the collar 63*e* (63*i*), a first spring holding portion 76 which holds one end of the control spring 68 including a compression coil spring shaped like a right circular cylinder in a natural state and a movable-side holding portion 78 which holds one end of the pressing spring 55 including a compression coil spring shaped like a right circular cylinder in a natural state are integrally formed and provided. Both spring holding portions 76, 78 are arranged to adjoin the supporting point 66*ea* (66*ia*) of the exhaust sub-rocker arm 66*e* (the intake sub-rocker arm 66*i*) in the axial direction A2 of the camshaft and arranged in the circumferential direction of the collar 63*e* (63*i*) with a space left (see FIG. 4).

In addition, on the collar 63*e* (63*i*), a convex part 63*e*1 (63*i*1) which is fitted into a hole 62*e*4 (62*i*4) formed in the second plate 62*e* (62*i*) is formed at a position away from a rocking center line L3 of the exhaust sub-rocker arm 66*e* (the intake sub-rocker arm 66*i*). The convex part 63*e*1 (63*i*1) and the hole 62*e*4 (62*i*4) constitute an engaging part which prevents relative rotation around the rocking center line L3 which is located between the second plate 62*e* (62*i*) and the collar 63*e* (63*i*). This engaging part prevents the collar 63*e* (63*i*) to which the same direction of torque is exerted by the spring force of the control spring 68 and the pressing spring 55 from rotating relative to the first and second plates 61*e* and 62*e* (61*i* and 62*i*) due to the provision of the pair of spring holding portions 76 and 78. Therefore, the operation that the pressing spring 55 applies the torque around the camshaft 50 to the link mechanisms M1*i* and M1*e* and the operation that the control spring 68 pushes against the exhaust driving cam 52 (the intake driving cam 51) are surely performed.

Referring to FIGS. 2 to 4, 6A, 6B, 7A to 7D, 10A and 10B, the exhaust sub-rocker arm 66*e* (the intake sub-rocker arm 66*i*) which is arranged between the first and the second plates 61*e* and 62*e* (61*i* and 62*i*) along with the exhaust cam 54 (the intake cam 53) and the exhaust driving cam 52 (the intake driving cam 51) comes in contact with the exhaust driving cam 52 (the intake driving cam 51) at a roller 66*eb* (66*ib*) which functions as a contacting part which comes in contact with the exhaust driving cam 52 (the intake driving cam 51) in the axial direction A2 of the camshaft, and is rockably supported by the supporting point 66*ea* (66*ia*) at its one end, and is fixed to the connecting pin 72 which is fixed to one end of the connecting link 67*e* (67*i*) at the connecting part 66*ec* (66*ic*) at its other end. For this reason, the exhaust sub-rocker arm 66*e* rocks around the collar 63*e* (63*i*) as a pivot center because the exhaust driving cam 52 (the intake driving cam 51) rotates along with the camshaft 50.

The exhaust cam 54 (the intake cam 53) pivotally supported by the connecting pin 73 which is fixed to the other end of the connecting link 67*e* (67*i*) is composed of rocking cams which are supported by the camshaft 50 through the bearing 44 and thus can rock around the camshaft 50. A cam surface is formed on a part of the circumferential surface of the exhaust cam. This cam surface consists of the base circle portion 54*a* (53*a*) which keeps the exhaust valve 23 (the intake valve 22) closed; and the cam swelled portion 54*b* (53*b*) which pushes down and open the exhaust valve 23 (the intake valve 22). The base circle portion 54*a* (53*a*) has a sectional shape of a circular arc with a fixed radius from the rotational center line L2, and the cam swelled portion 54*b* (53*b*) has a sectional shape of a circular arc which is increased in its radius from the rotational center line L2 in the reverse rotation direction R2 (the rotation direction R1) of the camshaft 50. For this reason, the cam swelled portion 54*b* (53*b*) of the exhaust cam 54 (the intake cam 53) has a shape in which the lift amount of the exhaust valve 23 (the intake valve 22) gradually increases in the reverse rotation direction R2 (the rotation direction R1).

The cam swelled portion 54*b* (53*b*) has a damping portion 54*b*1 (53*b*1) connected to the base circular portion 54*a* (53*a*) in order to decrease a slapping sound caused by the valve clearance C when the exhaust valve 23 (the intake valve 22) starts to open or caused by the contact with the valve sheet 24 when the exhaust valve 23 (the intake valve 22) starts to close (see FIGS. 6A, 6B, 10A and 10B). The damping portion 54*b*1 (53*b*1) having a height from the base circular portion 54*a* (53*a*) which gradually rises from zero is a portion in which a lift velocity, that is, a ratio of a change in height of the cam swelled portion to a change in rotational angle of the camshaft 50, is small and which includes a constant velocity portion, in the cam swelled portion 54*b* (53*a*).

The exhaust cam 54 (the intake cam 53) is rocked by the same amount around the camshaft 50 along with the exhaust link mechanism M1*e* (the intake link mechanism M1*i*) by the driving force of the driving mechanism M2 transmitted through the controlling mechanism M3, while it is rocked around the camshaft 50 along with the exhaust sub-rocker arm 66*e* (the intake sub-rocker arm 66*i*) which is rocked by the exhaust driving cam 52 (the intake driving cam 51). Moreover, the exhaust cam 54 (the intake cam 53) which rocks with respect to the camshaft 50 rocks the exhaust main rocker arm 42 (the intake main rocker arm 41), and opens or closes the exhaust valve 23 (the intake valve 22). For this reason, the exhaust cam 54 (the intake cam 53) is rocked by the driving force of the driving mechanism M2 which is sequentially transmitted through the holder 60*e* (60*i*), the exhaust sub-rocker arm 66*e* (the intake sub-rocker arm 66*i*) and the connecting link 67*e* (67*i*), and is rocked by the driving force of the exhaust driving cam 52 (the intake driving cam 51) which is sequentially transmitted through the exhaust sub-rocker arm 66*e* (the intake sub-rocker arm 66*i*) and the connecting link 67*e* (67*i*).

The control spring 68 which generates a spring force to push the rotor 66*eb* (66*ib*) of the exhaust sub-rocker arm 66*e* (the intake sub-rocker arm 66*i*) against the exhaust driving cam 52 (the intake driving cam 51) is arranged between the collar 63*e* (63*i*) and the exhaust cam 54, and can be expanded or contracted in the circumferential direction of the camshaft 50 according to the rocking of the exhaust sub-rocker arm 66*e* (the intake sub-rocker arm 66*i*). The other end of the control spring 68 having its one end held by the first spring holding portion 76 at the other end is held by the second spring holding portion 77 which is provided at a shelf-shaped protrusion integrally formed with the exhaust cam 54 (the intake cam 53).

The pressing spring 55 which always applies a spring force coming into action torque in one direction of the rocking direction to the exhaust link mechanism M1*e* (the intake link mechanism M1*i*) has its one end held by the movable-side spring holding portion 78 of the holder 60*e* (60*i*), and has its other end held by the fixed-side spring holding portion 79 which is provided in the camshaft holder 29 which functions as a fixing member fixed to the cylinder head 12.

The spring force of the pressing spring 55 which pushes the exhaust link mechanism M1*e* (the intake link mechanism M1*i*) against the cylinder 11 side directly acts on the holder 60*e* (60*i*) and pushes them toward the direction facing the cylinder 11, and the torque from each spring force which acts on the holder 60*e* (60*i*) turns to the one direction. Moreover, the one direction is set to the same direction as that of the torque that acts on the exhaust cam 54 (the intake cam 53) by the reaction force acting on the exhaust cam 54 (the intake cam 53) from the exhaust valve 23 (the intake valve 22) when the exhaust cam 54 (the intake cam 53) opens the exhaust valve 23 (the intake valve 22). For this reason, the direction that the spring force of the pressing spring 55 always pushes the connecting part 61*e*1 (61*i*1) against the connecting part 71*e*2 (71*i*2) in the rocking direction is the same as the direction that the reaction force pushes the connecting part 61*e*1 (61*i*1) against the connecting part 71*e*2 (71*i*2) in the rocking direction on the basis of the torque that acts on the holder 60*e* (60*i*) from the exhaust cam 54 (the intake cam 53) through the connecting link 67*e* (67*i*) and the exhaust sub-rocker arm 66*e* (the intake sub-rocker arm 66*i*).

Furthermore, in the respective connecting parts 71*e*2 and 61*e*1 (71*i*2 and 61*i*1) between which a slight gap exists due to the pivotal mounting, the pressing spring 55 always pushes one connecting part 61*e*1 (61*i*1) against the other connecting part 71*e*2 (71*i*2) in the rocking direction. When the first plate is rocked by the exhaust control link 71*e* (exhaust control link 71*i*), the effect of the gap between the connecting part 71*e*2 (71*i*2) and the connecting part 61*e*1 (61*i*1) is removed and the movement of the exhaust control link 71*e* (the intake control link 71*i*) is transmitted accurately to the holder 60*e* (60*i*).

With reference to FIGS. 2, 3 10A and 10B, the controlling mechanism M3 has a cylindrical control shaft 70 which functions as a control member driven by the driving mechanism M2; and control links 71*i* and 71*e* which transmit the movement of the control shaft 70 to the link mechanisms M1*i* and M1*e* and rocks the link mechanisms M1*i* and M1*e* around the camshaft 50.

The control shaft 70 is movable in the direction parallel to the cylinder axis L1. Accordingly, the control shaft 70 includes the rotational center line L2 of the camshaft 50 and is movable in the direction parallel to the reference plane H0 parallel to the cylinder axis L1.

The control links 71*i* and 71*e* are composed of the intake control link 71*i* and the exhaust control link 71*e*. The intake control link 71*i* is pivotally mounted to the control shaft 70 by the connecting part 71*i*1 and pivotally mounted to the connecting part 61*i*1 of the first plate 61*i* of the intake link mechanism M1*i* by the connecting part 71*i*2. The exhaust control link 71*e* is pivotally mounted to the control shaft 70 by the connecting part 71*e*1 and is pivotally mounted to the connecting part 61*e*1 of the first plate 61*e* of the exhaust link mechanism M1*e* by the connecting part 71*e*2. The connecting part 71*i*1 of the intake control link 71*i* and the connecting part 70*a* of the control shaft 70 respectively have a hole into which a connecting pin 71*e*3 which is press-fitted into and fixed to the hole of the connecting part 71*e*1 of the exhaust control link 71*e* is inserted in such a manner to be relatively rotatable, and they are pivotally supported by the connecting pin 71*e*3. The bifurcated connecting parts 71*i*2 and 71*e*2 respectively have a hole into which the connecting pins 61*i*1*a* and 61*e*1*a* of the connecting parts 71*i*2 and 71*e*2 are inserted in such a manner to be relatively rotatable, and they are pivotally mounted to the connecting pins 61*i*1*a* and 61*e*1*a*. Also, in the respective connecting parts 71*e*1 (71*i*1) and 70*a* between which a slight gap exists due to the pivotal mounting, the connecting part 71*e*1 (71*i*1) is always pushed against the connecting part 70*a*. Therefore, the effect of the gap (play) between the connecting part 71*e*1 (71*i*1) and the connecting part 70*a* is removed and the movement of the exhaust control link 70 is transmitted to the exhaust control link 71*e* (the intake control link 71*i*) accurately.

Figure 8:
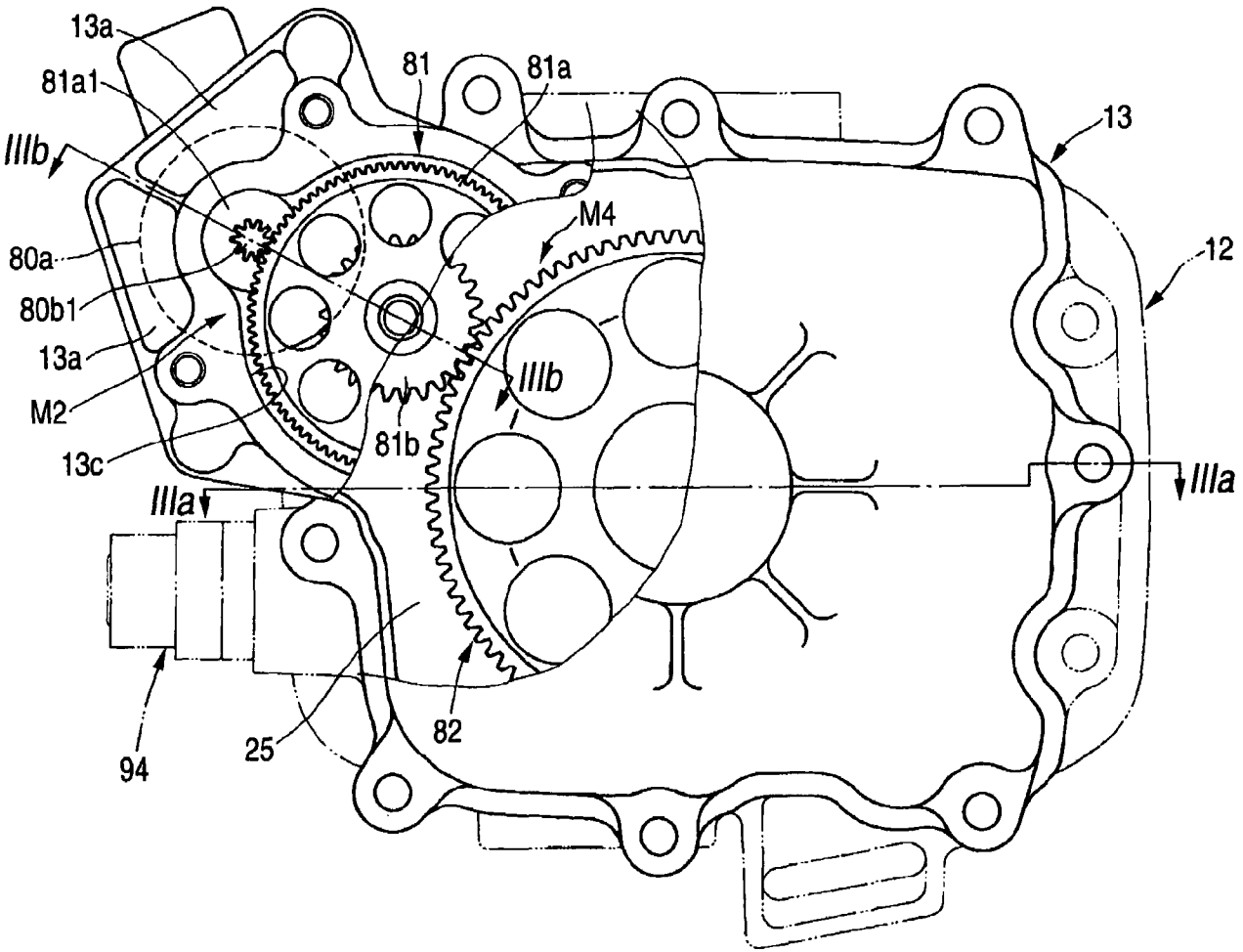
FIG. 8 is a diagram showing the head cover in the internal combustion engine of FIG. 1 as viewed from its front along an axis of the cylinder and is a partial cross-sectional view showing the driving mechanism of the variable valve characteristic mechanism.

Referring to FIGS. 3 and 8, the driving mechanism M2 which drives the control shaft 70 has the electric motor 80 which is mounted on the head cover 13 and can rotate reversibly; and a transmitting mechanism M4 which transmits the rotation of the electric motor 80 to the control shaft 70. Also, the controlling mechanism M3 and the driving mechanism M2 are arranged opposite to the cylinder 11 and the combustion chamber 16 with respect to the second orthogonal plane H2 that includes the rotational center line L2 and is orthogonal to the reference plane H0.

The electric motor 80 has a cylindrical main body 80*a* which accommodates a heat generating part such as a coil part; and an output shaft 80*b* which extends parallel to the cylinder axis L1. The electric motor 80 is arranged outside the cylinder head 12 and the head cover 13 in the diametrical direction of the valve operation chamber 25. Also, the power transmitting chamber 59 is arranged on the left side of the first orthogonal plane H1, and the main body 80*a* and the ignition plug 19 are arranged on the other side, i.e., the right side of the firth orthogonal plane H1. In the main body 80*a*, a through-hole 80*a*2 is formed in a mounted part 80*a*1 combined with a mounting part 13*a* which is formed on the head cover 13 to protrude in a shape of a visor in the diametrical direction, and the output shaft 80*b* passes through the through-hole 80*a*2 and protrudes to the outside of the main body 80*a* and extends to the inside of the valve operation chamber 25. The main body 80*a* is located at a position where the entire main body is covered with the mounting part as seen in the axial direction A1 of cylinder from the head cover 13 side or from the front of the head cover 13 (see FIG. 8).

Referring to FIGS. 2, 3 and 8, in the valve operation chamber 25, the transmitting mechanism M4 arranged between the camshaft holder 29 and the head cover 13 in the axial direction A1 of the cylinder consists of a reduction gear 81 which meshes with a driving gear 80*b*1 formed on an output shaft 80*b* which passes through the head cover 13 and extends into the valve operation chamber 25; and an output gear 82 which meshes with the reduction gear 81 and is rotatably supported by the cylinder head 12 through the camshaft holder 29. The reduction gear 81 is rotatably supported by a supporting shaft 84 which is supported by the head cover 13 and a cover 83 which covers the opening 13*c* formed in the head cover 13, and has a large gear 81*a* which meshes with the driving gear 80*b*1; and a small gear 81*b* which meshes with the output gear 82. The output gear 82 has a cylindrical boss part 82*a* which is rotatably supported by a holding tube 88 combined with the camshaft holder 29 with bolts through a bearing 89.

The output gear 82 and the control shaft 70 are drivingly connected to a feed screw mechanism which functions as a motion converting mechanism that converts the rotational motion of the output gear 82 to the straight reciprocating motion of the control shaft 70 which is parallel to the cylinder axis L1. The feed screw mechanism has a female screw part 82*b*, such as a trapezoidal screw, formed on an inner circumferential surface of the boss part 82*a*; and a male screw part 70*b*, such as a trapezoidal screw, formed on an outer circumferential surface of the control shaft 70 and screwed to the female screw part 82*b*. The control shaft 70 is slidably fitted to the outer circumferential surface of the guide shaft 90 which is fixed to the boss part 82*a* can advance to or retreat from the camshaft 50 in the axial direction A1 of the cylinder through a through-hole 91 (see FIG. 5) formed on the camshaft holder 29 in a state in which it is guided by the guide shaft 90.

Referring to FIG. 3, the electric motor 80 is controlled by the electronic control unit (hereinafter referred to as an ECU) 92. For this reason, detection signals from an operating state detecting means 93 which detects operating states of the internal combustion engine E and has a starting detecting means for detecting the starting timing of the internal combustion engine E, a load detecting means for detecting an engine load, an engine revolution speed detecting means for detecting the engine revolution speed; and also detection signals from a rocking position detecting means 94 (for example, composed of potentiometer) which detects a rocking position which is a rocking angle of the holder 60*e* of the exhaust link mechanism M1*e* which is rocked by the electric motor 80 and further the exhaust cam 54 with respect to the camshaft 50 are input to the ECU 92.

For this reason, if the position of the control shaft 70 driven by the electric motor 80 changes, the rocking positions, that is, the rotational positions of the exhaust link mechanism M1*e* (the intake link mechanism M1*i*) and the exhaust cam 54 (the intake cam 53) with respect to the camshaft 50 change according to operating states. Thus, the valve operation characteristics of the exhaust valve 23 (the intake valve 22) are controlled according to the operating states of the internal combustion engine E by means of the variable valve characteristic mechanism M which is controlled by the ECU 92.

Figure 9:
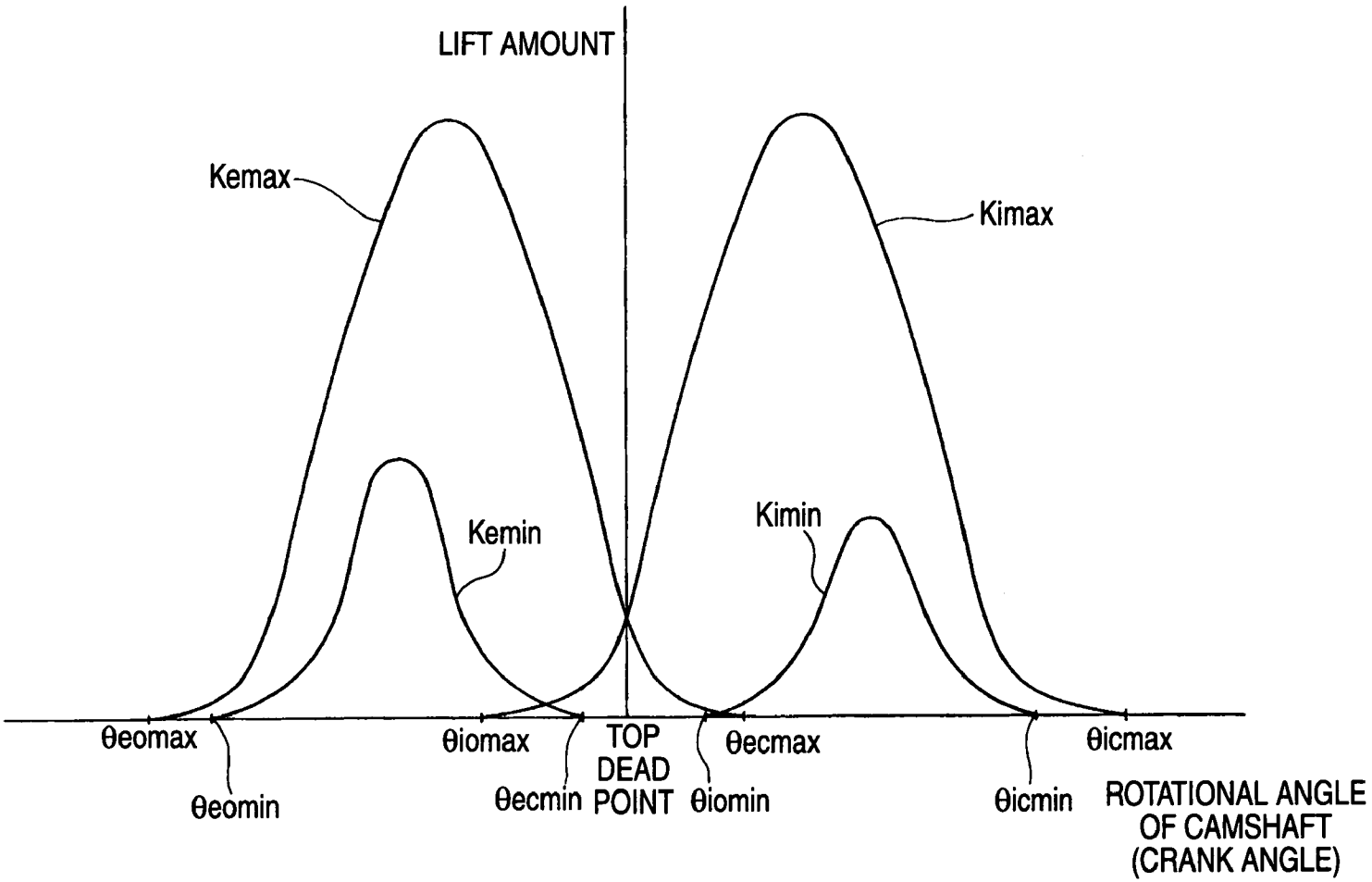
FIG. 9 is a diagram illustrating valve operation characteristics the exhaust valve and the intake valve by the valve operation device of the internal combustion engine of FIG. 1.

The detailed description is as follows:

As shown in FIG. 9, the intake valve and the exhaust valve open or close respectively according to basic operating characteristics of the valve operation characteristics Ki and Ke which are controlled by the variable valve characteristic mechanism M which changes the opening and closing timing and the maximum lift amount, i.e., an arbitrary intermediate operating characteristic between a maximum valve operation characteristics Kimax and Kemax and a minimum valve operation characteristics Kimin and Kemin in which the maximum valve operation characteristics Kimax and Kemax and the minimum valve operation characteristics Kimin and Kemin are used as boundary values. For this reason, in the intake valve 22, as the opening timing retards continuously, the closing timing advances continuously, the opening period becomes shorter continuously, the rotation angle of the camshaft 50 (or the crank angle which is the rotating position of the crankshaft 15) where the maximum lift amount can be obtained retards continuously, and the maximum lift amount becomes smaller continuously. Also, at the same time with the change in the valve operation characteristic of the intake valve 22, in the exhaust valve 23, as its opening timing retards continuously, the closing timing advances continuously, the opening period becomes shorter continuously, and the rotation angle of the camshaft 50 where the maximum lift amount can be obtained advances continuously and the maximum lift amount becomes smaller continuously.

Figure 10A:
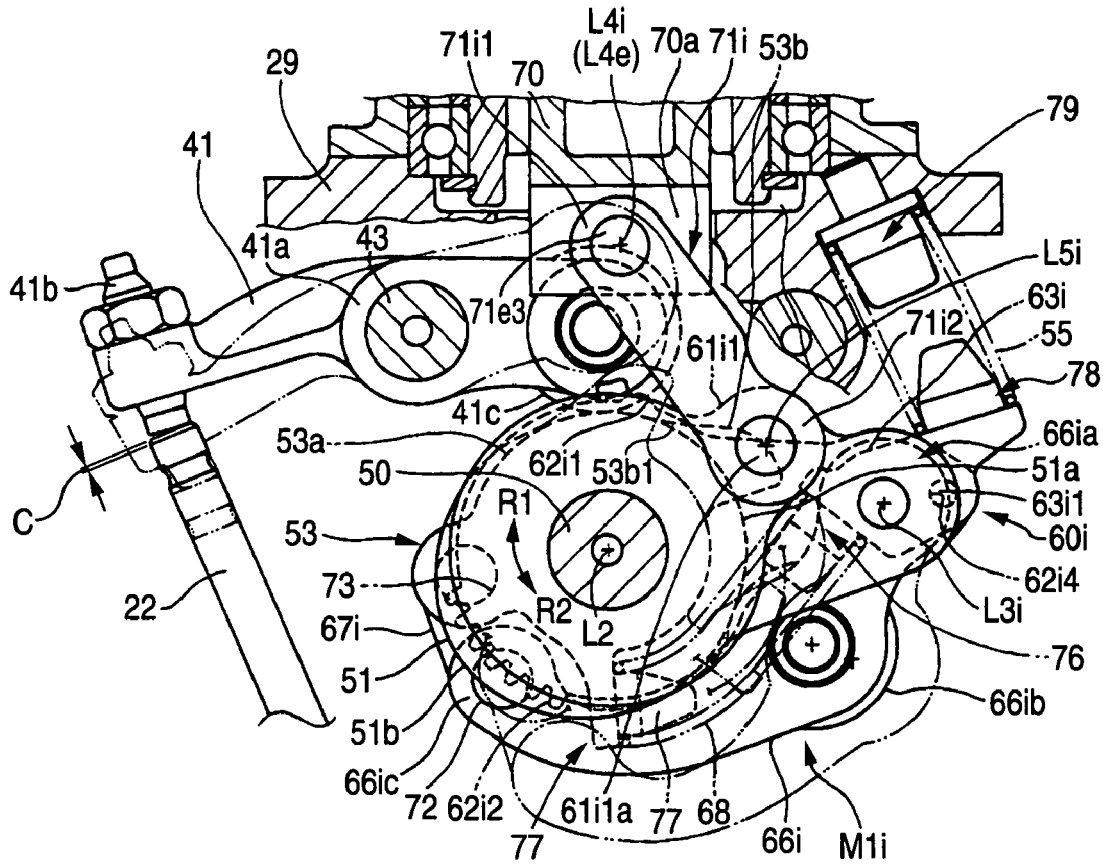
FIG. 10A is an explanatory view of essential parts of the variable valve characteristic mechanism when a maximum valve operation characteristic is obtained with respect to the intake valve of the valve operation device of the internal combustion engine of FIG. 1
Figure 10B:
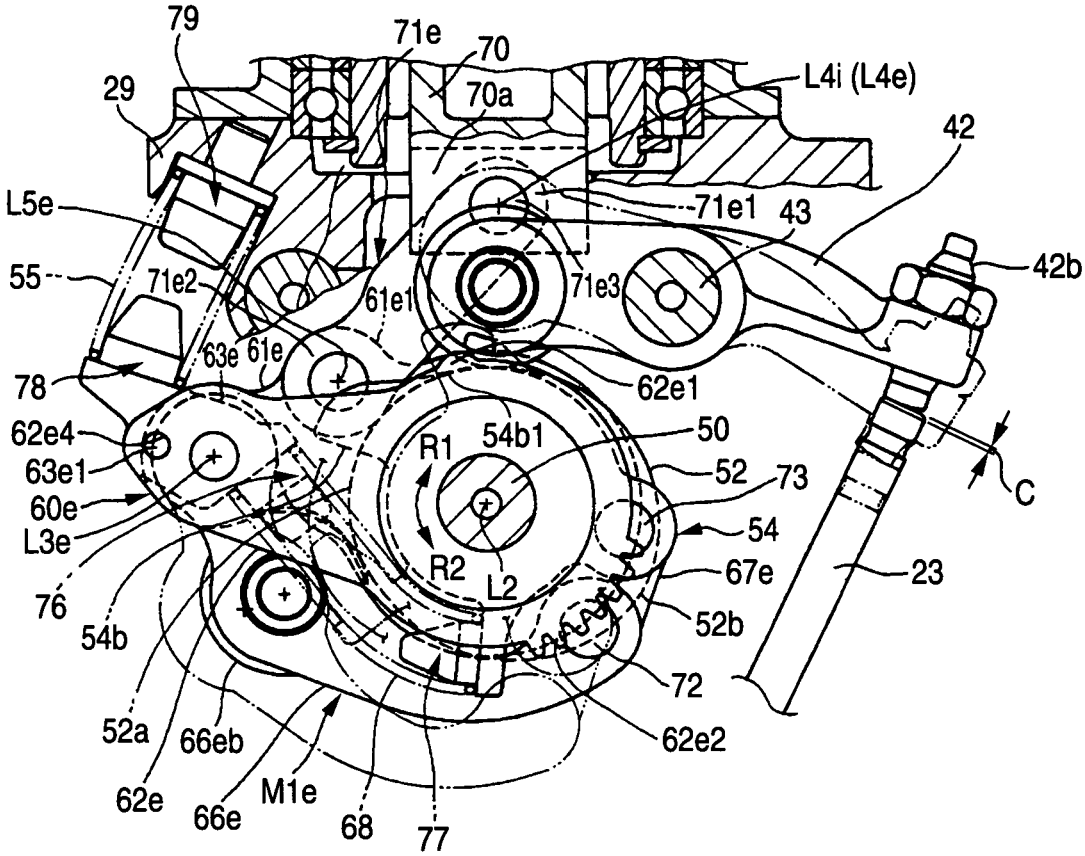
FIG. 10B is an explanatory view of essential parts of the variable valve characteristic mechanism when a maximum valve operation characteristic is obtained with respect to the exhaust valve, which corresponds to a schematic enlarged view of FIG. 2.

Referring to FIGS. 10A and 10B, when the control shaft 70 and the intake control link 71 which are driven by the driving mechanism M2 occupy the first position shown in FIGS. 10A and 10B, the opening timing of the intake valve 22 becomes the most advanced angle position θiomax and its closing timing becomes the most retarded angle position θicmax, and the maximum valve operation characteristic Kimax in which both the opening period and the maximum lift amount become the maximum can be obtained. At the same time, the opening timing of the exhaust valve 23 becomes the most advanced angle position θeomax and its closing timing becomes the most retarded angle position θecmax, and the maximum valve operation characteristic Kemax in which both the opening period and the maximum lift amount become the maximum can be obtained.

In addition, in FIGS. 10A, 10B, 11A and 11B, the state of the exhaust link mechanism M1*e* (the intake link mechanism M1*i*) and the exhaust main rocker arm 42 (the intake main rocker arm 41) are indicated by solid lines when the exhaust valve 23 (the intake valve 22) opens, and the state outline of the exhaust link mechanism M1*e* (the intake link mechanism M1*i*) and the exhaust main rocker arm 42 (the intake main rocker arm 41) is indicated by two-dot chain lines when the exhaust valve 23 (the intake valve 22) opens with the maximum lift amount.

When a valve operation characteristic is shifted from the state where the maximum valve operation characteristics Kimax and Kemax can be obtained to the state where the minimum valve operation characteristics Kimin and Kemin can be obtained by the variable valve characteristic mechanism M according to the operating state of the internal combustion engine E, the electric motor 80 drives to rotate the output gear 72, and the feed screw mechanism advances the control shaft 70 toward the camshaft 50. In this case, on the basis of the driving amount of the electric motor 80, the control shaft 70 rocks the intake link mechanism M1*i* and the intake cam 53 around the camshaft 50 in the rotation direction R1 through the intake control link 71*i*, and simultaneously rocks the exhaust link mechanism M1*e* and the exhaust cam 54 around the camshaft 50 in the reverse rotation direction R2 through the exhaust control link 71*e*.

Figure 11A:
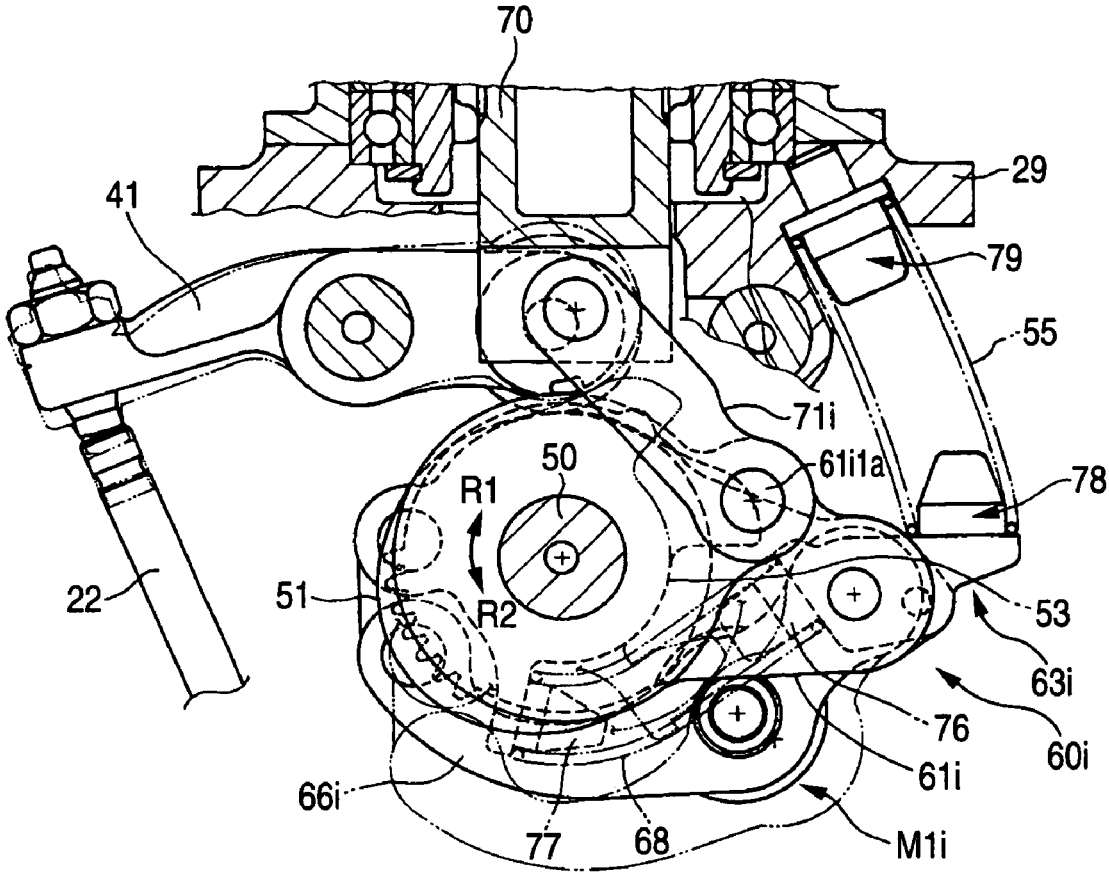
FIG. 11A is a diagram corresponding to FIG. 10A when a minimum valve operation characteristic is obtained with respect to the intake valve and FIG. 11B is a diagram corresponding to FIG. 10B when a minimum valve operation characteristic is obtained with respect to the exhaust valve.
Figure 11B:
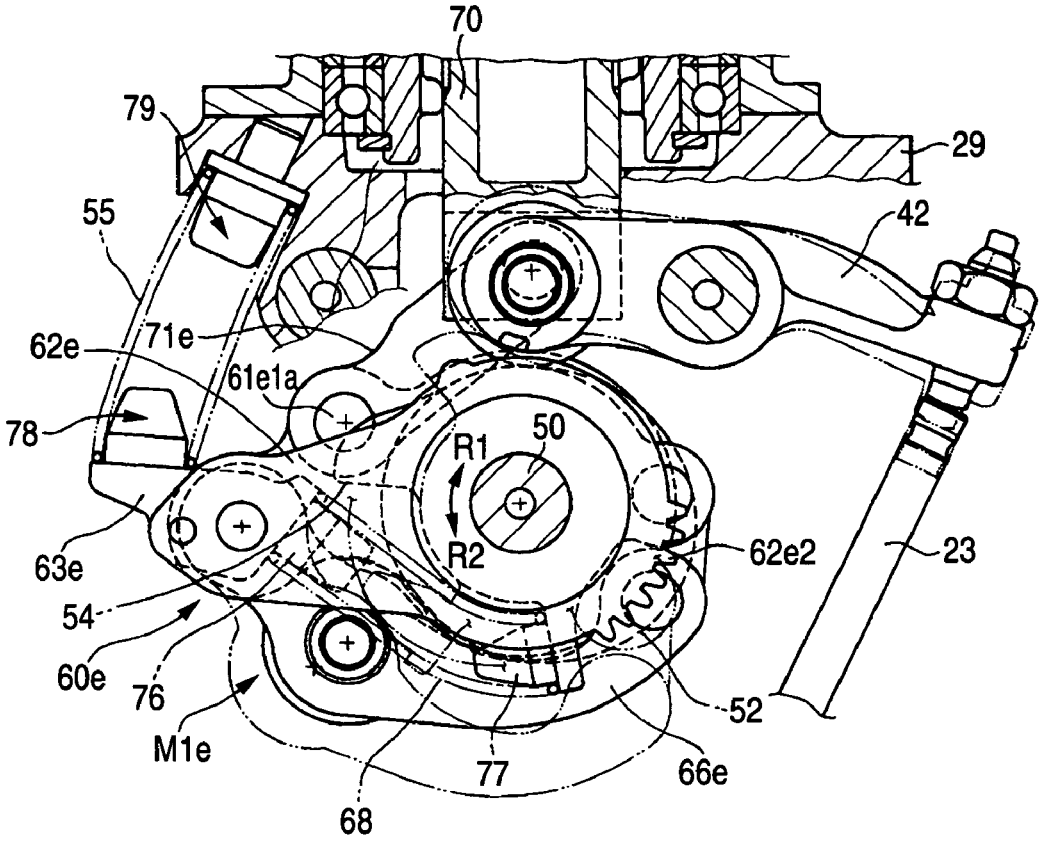
Figure 12A:
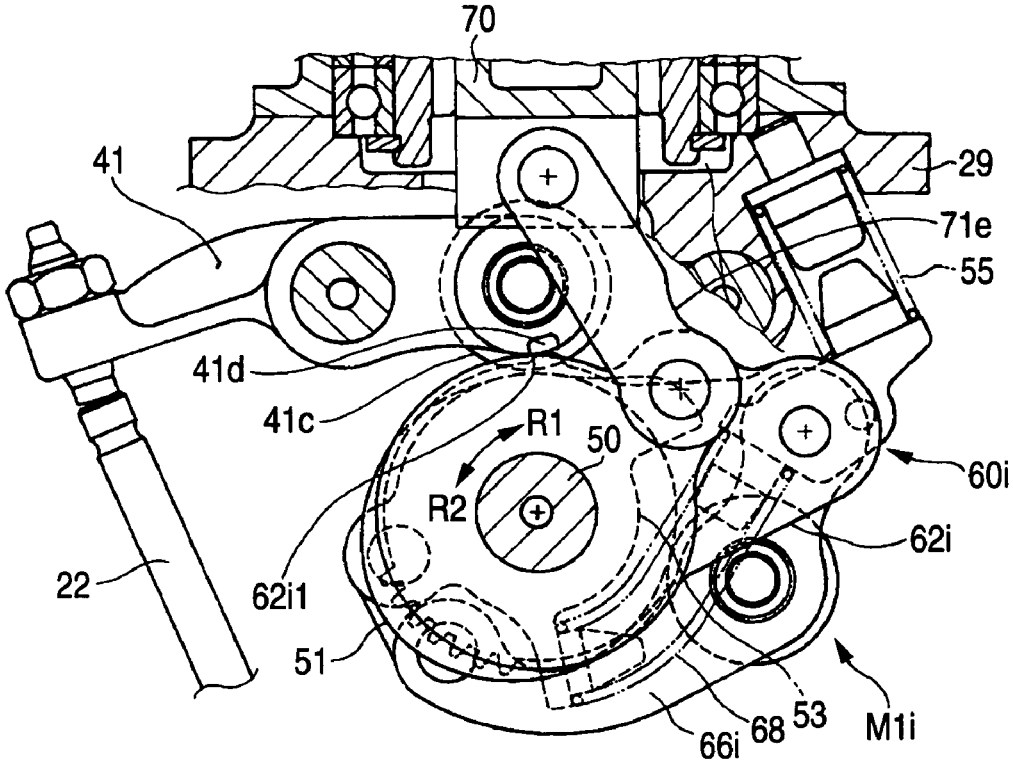
FIG. 12A is a diagram corresponding to FIG. 10A when a decompressed operation characteristic is obtained with respect to the intake valve and FIG. 12B is a diagram corresponding to FIG. 10B when a decompressed operation characteristic is obtained with respect to the exhaust valve.
Figure 12B:
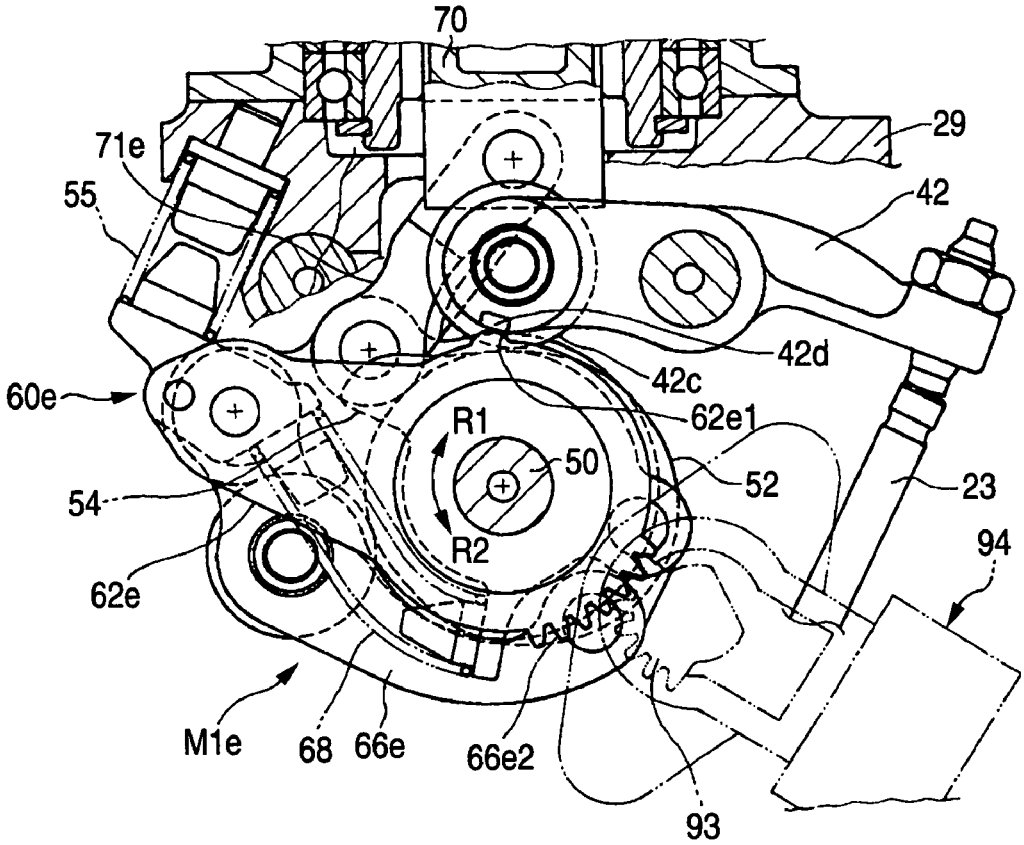

Moreover, when the control shaft 70 and the exhaust control link 71*e* occupy the second position shown in FIGS. 11A and 11B, the opening timing of the intake valve 22 becomes the most retarded angle position θiomin and its closing timing becomes the most advanced angle position θicmin, and the minimum valve operation characteristic Kimax in which both the opening timing and the maximum lift amount altogether become the minimum can be obtained. At the same time, the opening timing of the exhaust valve 23 becomes the most retarded angle position θeomin, and its closing timing becomes the most advanced angle position θecmin, and the minimum valve operation characteristic Kemin in which both the opening timing and the maximum lift amount become the minimum can be obtained.

Moreover, when the control shaft 70 is shifted from the second position to the first position, the electric motor 80 drive to rotate the output gear 82 in the counter direction, and the feed screw mechanism retreats the control shaft 70 to be separated from the camshaft 50. In this case, the control shaft 70 rocks the intake link mechanism M1*i* and the intake cam 53 around the camshaft 50 in the reverse rotation direction R2 through the intake control link 71*i*, and simultaneously rock the exhaust link mechanism M1*e* and the exhaust cam 54 around the camshaft 50 in the rotation direction R1 through the exhaust control link 71*e*.

In addition, when the control shaft 70 occupies a position between the first position and the second position, for the exhaust valve 23 (the intake valve 22), numerous intermediate valve operation characteristics such as the opening timing, the closing timing, the valve opening period and the maximum lift amount, which are set to values of valve operation characteristics between the maximum valve operation characteristic Kemax (Kimax) and the minimum valve operation characteristic Kemin (Kimin), can be obtained.

Moreover, in addition to the basic operating characteristic, the intake valve and the exhaust valve are respectively opened or closed according to an auxiliary operating characteristic by the valve characteristic mechanism M. Specifically, the fact that the decompression operating characteristic is obtained as the auxiliary operating characteristic will be described with reference to FIGS. 12A and 12B. In the compression stroke at the starting of the internal combustion engine E, the electric motor 80 drives to rotate the output gear 82 in the counter direction, and the control shaft 70 occupies a decompression position where it retreats to be separated from the camshaft 50 over the first position. In this case, the exhaust link mechanism M1*e* (the intake link mechanism M1*i*) and the exhaust cam 54 (the intake cam 53) rock in the rotation direction R1 (the reverse rotation direction R2), and the decompression cam 62*e*1 (62*i*1) of the second plate 62*e* (62*i*) comes in contact with the decompression part 42*d* (41*d*) provided in the vicinity of the roller 42*c* (41*c*) of the exhaust main rocker arm 42 (the intake main rocker arm 41), and the roller 42*c* (41*c*) is separated from the exhaust cam 54 (the intake cam 53), and the exhaust valve 23 (the intake valve 22) opens with a small degree of decompression opening.

Figure 13:
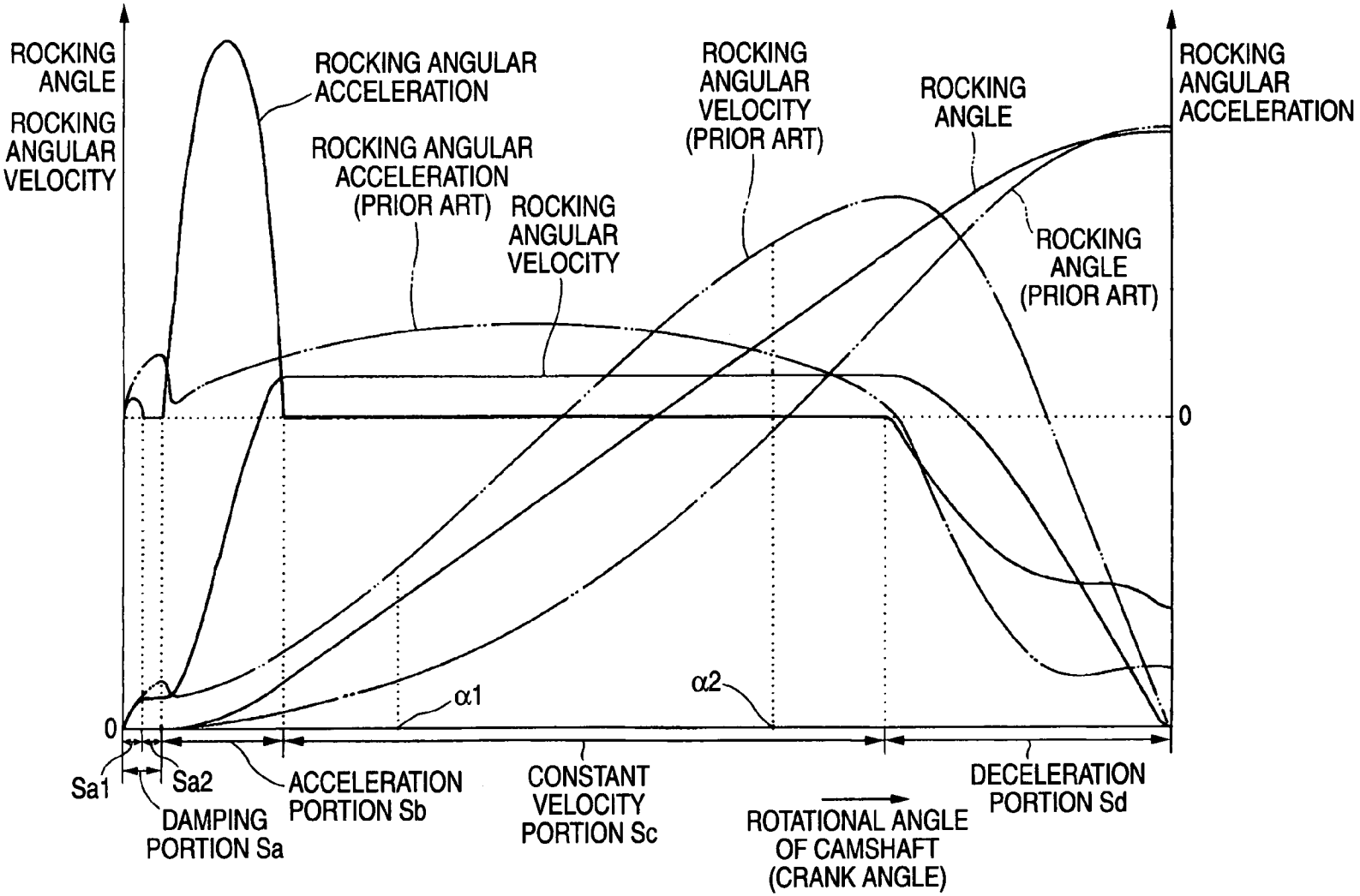
FIG. 13 is a graph illustrating changes in rocking angle, rocking angular velocity, and rocking angular acceleration of the exhaust cam (the intake cam) corresponding a height, a lift velocity, and a lift acceleration of a cam swelled portion of the exhaust driving cam (the intake driving cam) respectively with respect to an rotational angle of the camshaft, and changes in rocking angle, rocking angular velocity, and rocking angular acceleration of the rocking cam corresponding to a height, a lift velocity, and a lift acceleration of the cam swelled portion of the rotational cam in the prior art respectively in the valve operation device of the internal combustion engine of FIG. 1.

Referring to FIG. 13, in a first half portion in which the height of the cam swelled portion 52*b* (51*b*) increases, the cam swelled portion 52*b* (51*b*) of the exhaust driving cam 52 (the intake driving cam 51) has a damping portion Sa including a transfer portion Sa1 in which a lift velocity increases as a state where a lift velocity is zero at the base circle portion 52*a* (51*a*) transfers to the cam swelled portion 52*b* (51*b*) and a damping constant velocity portion Sa2 in which the lift velocity is constant, an acceleration portion Sb, connected to the damping portion Sa, in which the lift velocity increases, a constant velocity portion Sc in which the lift velocity is constant, and a deceleration portion Sd in which the lift velocity decreases. Therefore, the damping constant velocity portion Sa2 and the constant velocity portion Sc are portions in which the lift acceleration, that is, a ratio of a change in the lift velocity with respect to a change in rotational angle of the camshaft 50, is 0 (zero). And, the transfer portion Sa1 and the acceleration portion Sb are portions in which the lift acceleration is positive, and the deceleration portion Sd is a portion in which the lift acceleration is negative. Referring to FIG. 13, a vertical axis represents a rocking angle, a rocking angular velocity, and a rocking angular acceleration of the exhaust cam 54 (the intake cam 53) rocked by the exhaust driving cam 52 (the intake driving cam 51) via the exhaust sub-rocker arm 66*e* (the intake sub-rocker arm 66*i*). And, the rocking angle, the rocking angular velocity, and the rocking angular acceleration respectively correspond to the height of the cam swelled portion 52*b* (51*b*) of the exhaust driving cam 52 (the intake driving cam 51), the lift velocity, and the lift acceleration.

Figure 14:
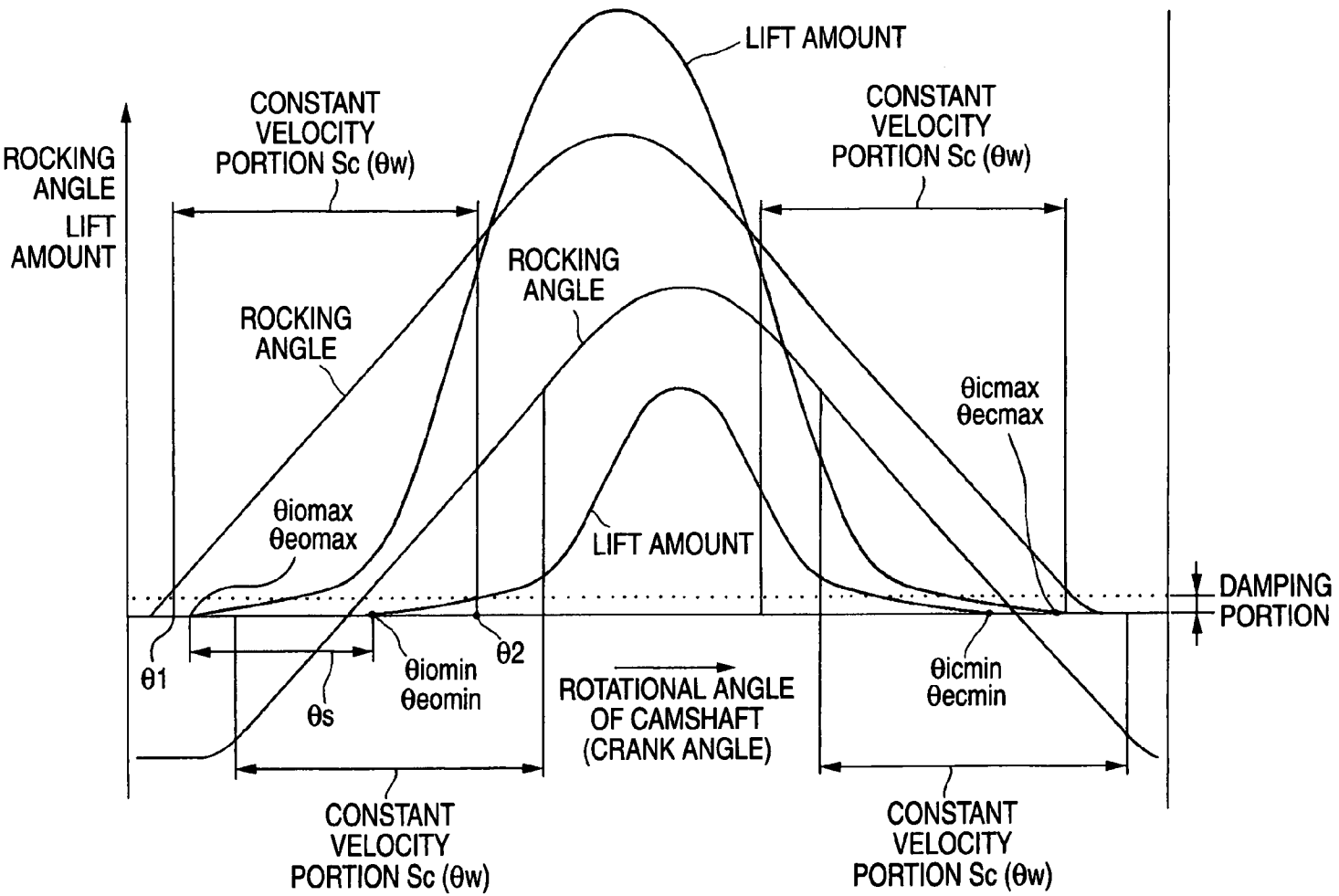
FIG. 14 is a graph illustrating a change in rocking angle of the exhaust cam (the intake cam) and a change in lift amount of the exhaust valve (the intake valve) with respect to the rotational angle of the camshaft with the maximum valve operation characteristic and the minimum valve operation characteristic in the valve operation device of the internal combustion engine of FIG. 1.
Figure 15:
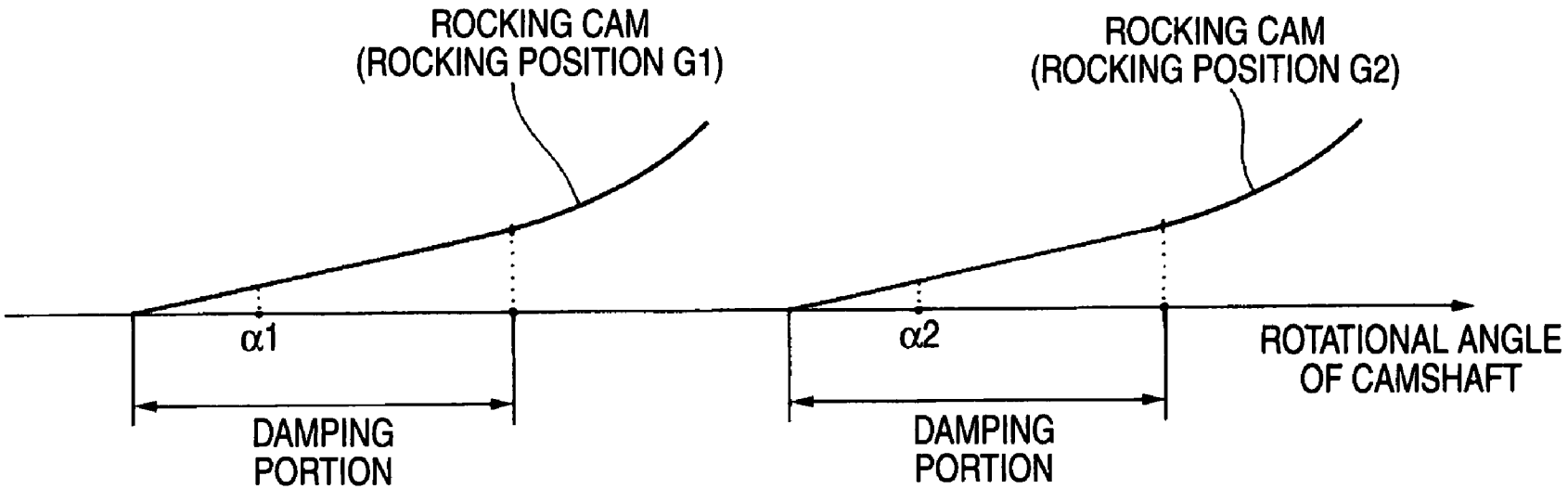
FIG. 15 is a diagram illustrating a relationship between a dumping of the rocking cam and a rotational angle of a driving shaft.

Referring also to FIG. 14, the constant velocity portion Sc is consecutively provided over an angular width θw where at least the opening timing of the exhaust valve 23 (the intake valve 22) in the most advanced angle position θeomax (θiomax) of the maximum valve operation characteristic Kemax (Kimax) and the opening timing of the exhaust valve 23 (the intake valve 22) in the most retarded angle position θeomin (θiomin) of the minimum valve operation characteristic Kemin (Kimin) are included. In this embodiment, the angular width θw includes at least an angular range θs which ranges from the opening timing of the exhaust valve 23 (the intake valve 22) in the most advanced angle position to the closing timing of the exhaust cam 54 (the intake cam 53) in the most retarded angle position. And, the angular width θw is set to include a starting position θ1 of the damping portion of the exhaust cam 54 (the intake cam 53) in the most advanced angle position θeomax (θinmax) and an ending position θ2 of the damping portion in the most retarded angle position θeomin (θiomin), thereby to become large than the angular range θs.

As for the second half portion in which the height of the cam swelled portion 52*b* (51*b*) decreases, change forms of the height and the lift acceleration are linearly symmetric to the first half portion, and a change form of the lift velocity (that is, the rocking angular velocity of the exhaust cam 54 (the intake cam 53)) is pointlike symmetric to the first half portion. And, at the closing timing of the exhaust valve 23 (the intake valve 22), the same angular width θw of the first half portion is set to correspond to the most retarded angle position θecmax (θicmax) in the maximum valve operation characteristic Kemax (Kimax) and the most advanced angle position θecmin (θicmin) in the minimum valve operation characteristic Kemin (Kimin).

Therefore, if the engine rotational velocity (that is, the rotational velocity of the camshaft 50) is the same, all the valve operation characteristics ranging from the maximum valve operation characteristic Kemax (Kimax) in which the opening timing of the exhaust valve 23 (the intake valve 22) is the most advanced angle position θeomax (θiomax), to the minimum valve operation characteristic Kemin (Kimin) in which the opening timing of the exhaust valve 23 (the intake valve 22) is the most retarded angle position θeomin (θiomin) through all the intermediate valve operation characteristics, the exhaust main rocker arm 42 (the intake main rocker arm 41) comes into contact with the damping portion 54*b*1 (53*b*1) of the exhaust cam 54 (the intake cam 53) which rocks at the same rocking angular velocity, and the exhaust main rocker arm 42 (the intake main rocker arm 41) is rocked by the damping portion 54*b*1 (53*b*1) at the same rocking angular velocity. Therefore, even if the valve clearance C set below the height of the cam swelled portion 54*b* (53*b*) in an ending position of the damping portion 54*b*1 (53*b*1) of the exhaust cam 54 (the intake cam 53) is removed, the exhaust main rocker arm 42 (the intake main rocker arm 41) comes into contact with the exhaust valve 23 (the intake valve 22) and the exhaust valve (the intake valve 22) comes into contact with the valve sheet 24, respectively at the same velocity at all times, regardless of the valve operation characteristics which are controlled by the variable valve characteristic mechanism M.

The operations and the advantages of the embodiment constructed in such a manner will be described later. The variable valve characteristic mechanism M has the exhaust cam 54 (the intake cam 53) pivotally supported on the camshaft 50 to open and close the exhaust valve 23 (the intake valve 22), the exhaust link mechanism M1*e* (the intake link mechanism M1*i*) which rocks the exhaust cam 54 (the intake cam 53) around the camshaft 50 by the exhaust driving cam 52 (the intake driving cam 51) rotating with the camshaft 50 integrally, and the driving mechanism M2 which rocks the exhaust link mechanism M1*e* (the intake link mechanism M1*i*) around the camshaft 50. In the variable valve characteristic mechanism M, opening and closing of the exhaust valve 23 (the intake valve 22) start in the damping portion 54*b*1 (53*b*1) of the exhaust cam 54 (the intake cam 53), and the driving mechanism M2 rocks the exhaust cam 54 (the intake cam 53) around the camshaft 50 via the exhaust link mechanism M1*e* (the intake link mechanism M1*i*) to control the opening timing and the closing timing of the exhaust valve 23 (the intake valve 22). And, as for the variable valve characteristic mechanism M, the cam swelled portion 52*b* (51*b*) of the exhaust driving cam 52 (the intake driving cam 51) has the constant velocity portion Sc in which the lift velocity (that is, the rocking angular velocity of the exhaust cam 54 (the intake cam 53)) is constant. Further, the constant velocity portion Sc is provided over the angular width θw which includes the opening timing of the exhaust valve 23 (the intake valve 22) in the most advanced angle position θeomax (θiomax) when the exhaust valve 23 (the intake valve 22) opens and the opening timing of the exhaust valve 23 (the intake valve 22) in the most retarded angle position θeomin (θiomin) when the exhaust valve 23 (the intake valve 22) opens. Thus, the exhaust valve (the intake valve 22) is opened and closed by the damping portion 54*b*1 (53*b*1) of the exhaust cam 54 (the intake cam 53) which is rocked at the same rocking angular velocity by the constant velocity portion when the opening timing and the closing timing of the exhaust valve 23 (the intake valve 22) are provided at the most advanced angle positions θeomax (θiomax) and θecmin (θicmin), the most retarded angle positions θeomin (θiomin) and θecmax (θicmax), and an arbitrary position between the most advanced angle positions θeomax (θiomax) and θecmin (θicmin) and the most retarded angle positions θeomin (θiomin) and θecmax (θicmax). Therefore, the damping portion 54*b*1 (53*b*1) having the same rocking angular velocity continuously starts to open and close regardless of changes in opening timing and closing timing through controls of the opening timing and the closing timing. As a result, the slapping sound of the exhaust valve 23 (the intake valve 22) caused by the valve clearance C and caused when the exhaust valve 23 (the intake valve 22) is seated to the valve seat 24, according to the changes in opening timing and closing timing, is prevented from occurring.

The internal combustion engine E may be a multicylinder internal combustion engine. Further, the internal combustion engine E may be an internal combustion engine whose one cylinder has a plurality of intake valves and one or a plurality of exhaust valves, or an internal combustion engine whose one cylinder has a plurality of exhaust valves and one or a plurality of intake valves.

What is claimed is:

1. A valve operation device of an internal combustion engine, comprising:

a camshaft which interlockingly rotates around a crankshaft of the internal combustion engine;

a valve operation cam pivotally supported on the camshaft to open and close an engine valve that comprises one of an intake valve and an exhaust valve;

a driving cam which integrally rotates with the camshaft;

an interlocking mechanism through which the driving cam rocks the valve operation cam around the camshaft; and a driving mechanism which rocks the interlocking mechanism around the camshaft, wherein the driving cam includes a base circle portion having a sectional shape of a circular arc, and a cam swelled portion having a sectional shape in which a radius from a center different from a center of the base circle portion increases and decreases in a rotation direction of the camshaft, opening and closing of the engine valve start at a damping portion of the valve operation cam, and the driving mechanism rocks the valve operation cam around the camshaft via the interlocking mechanism to control an opening timing and a closing timing of the engine valve, and the cam swelled portion of the driving cam has a constant velocity portion at which a lift velocity, which is a ratio of a change in a height of the cam swelled portion with respect to a change in a rotational angle of the camshaft, is constant, and the constant velocity portion is provided over an angular width that includes at least the opening timing in a most advanced angle position of the opening timing of the engine valve and the opening timing in a most retarded angle position of the opening timing of the engine valve.

2. The valve operation device of an internal combustion engine according to claim 1, wherein the angular width includes at least an angular range which ranges from the opening timing in the most advanced angle position of the engine valve to the closing timing in the most retarded angle position of the engine valve.

3. The valve operation device of an internal combustion engine according to claim 2, wherein the angular width includes a starting position of the damping portion of the valve operation cam in the most advanced angle position and an ending position of the damping portion of the valve operation cam in the most retarded angle position.

* * * * *